US009129486B2

(12) United States Patent
Nicely et al.

(10) Patent No.: US 9,129,486 B2
(45) Date of Patent: Sep. 8, 2015

(54) GAMING SYSTEM AND METHOD PROVIDING A CARD GAME ASSOCIATED WITH A SUPPLEMENTAL POOL FUNDED UPON AN OCCURRENCE OF A DESIGNATED OUTCOME AND WINNABLE BY A PLAYER OR A DEALER

(71) Applicant: IGT, Reno, NV (US)

(72) Inventors: Mark C. Nicely, Daly City, CA (US); Leandro Basallo, San Francisco, CA (US); Timothy L. Isaacson, Hayward, CA (US); Ricky J. Lew, Honolulu, HI (US)

(73) Assignee: IGT, Las Vegas, NV (US)

( * ) Notice: Subject to any disclaimer, the term of this patent is extended or adjusted under 35 U.S.C. 154(b) by 246 days.

(21) Appl. No.: 13/626,608

(22) Filed: Sep. 25, 2012

(65) Prior Publication Data

US 2014/0087801 A1 Mar. 27, 2014

(51) Int. Cl.
*G07F 17/00* (2006.01)
*G07F 17/32* (2006.01)

(52) U.S. Cl.
CPC ..... *G07F 17/3293* (2013.01); *G07F 17/3258* (2013.01)

(58) Field of Classification Search
CPC ..... G07F 17/3276; G07F 17/32
USPC ..... 463/27, 42
See application file for complete search history.

(56) References Cited

U.S. PATENT DOCUMENTS 5,100,137 A 3/1992 Fulton et al.
5,154,429 A 10/1992 Levasseur et al.
5,167,413 A 12/1992 Fulton et al.
5,251,897 A 10/1993 Fulton et al.
5,257,789 A 11/1993 Levasseur et al.
5,257,810 A 11/1993 Schorr et al.
5,280,909 A 1/1994 Tracy et al.
5,322,295 A 6/1994 Cabot et al.
5,344,144 A 9/1994 Canon et al.
5,364,104 A 11/1994 Jones et al.
5,374,067 A 12/1994 Jones et al.
5,377,973 A 1/1995 Jones et al.
5,380,012 A 1/1995 Jones et al.
5,382,025 A 1/1995 Sklansky et al.
5,411,257 A 5/1995 Fulton et al.
5,431,408 A 7/1995 Adams et al.
5,437,451 A 8/1995 Fulton et al.
5,437,462 A 8/1995 Breeding et al.
5,531,448 A 7/1996 Moody et al.
5,570,885 A 11/1996 Ornstein (Continued)

*Primary Examiner* — Reginald Renwick

(74) *Attorney, Agent, or Firm* — Neal, Gerber & Eisenberg LLP

(57) ABSTRACT

In various embodiments, the gaming system of the present disclosure is configured to operate a card game. For a play of the card game, the gaming system receives a wager, determines a plurality of player cards from a plurality of cards, displays the player cards face up, determines a plurality of dealer cards from the plurality of cards, and displays at least one of the dealer cards face up. The gaming system determines an outcome of the play by comparing the player and the dealer cards. If the outcome is a designated outcome, the gaming system funds a supplemental pool with the received wager. If a supplemental pool payout condition is met, the gaming system provides the supplemental pool to a player. If a supplemental pool reset condition other than the player winning the supplemental pool is met, the gaming system resets the supplemental pool to an initial value.

44 Claims, 18 Drawing Sheets

(56) References Cited

U.S. PATENT DOCUMENTS

| | | | |
|---|---|---|---|
| 5,636,842 | A | 6/1997 | Cabot et al. |
| 5,718,431 | A | 2/1998 | Ornstein et al. |
| 5,732,950 | A | 3/1998 | Moody et al. |
| 5,755,621 | A | 5/1998 | Marks et al. |
| 5,766,076 | A | 6/1998 | Pease et al. |
| 5,803,809 | A | 9/1998 | Yoseloff |
| 5,820,460 | A | 10/1998 | Fulton et al. |
| 5,823,873 | A | 10/1998 | Moody et al. |
| 5,833,536 | A | 11/1998 | Davids et al. |
| 5,855,515 | A | 1/1999 | Pease et al. |
| 5,863,042 | A | 1/1999 | Lo et al. |
| 5,882,259 | A | 3/1999 | Holmes et al. |
| 5,885,158 | A | 3/1999 | Torango et al. |
| 5,911,418 | A | 6/1999 | Adams et al. |
| 5,954,335 | A | 9/1999 | Moody et al. |
| 5,957,774 | A | 9/1999 | Holmes et al. |
| 6,007,066 | A | 12/1999 | Moody et al. |
| 6,007,424 | A | 12/1999 | Evers et al. |
| 6,050,658 | A | 4/2000 | O'Sullivan et al. |
| 6,062,979 | A | 5/2000 | Inoue |
| 6,098,985 | A | 8/2000 | Moody et al. |
| 6,110,043 | A | 8/2000 | Olsen |
| 6,135,883 | A | 10/2000 | Hachquet |
| 6,146,273 | A | 11/2000 | Olsen |
| 6,155,568 | A | 12/2000 | Franklin |
| 6,176,781 | B1 | 1/2001 | Walker et al. |
| 6,193,235 | B1 | 2/2001 | Vancura et al. |
| 6,196,547 | B1 | 3/2001 | Pascal et al. |
| 6,203,010 | B1 | 3/2001 | Jorasch et al. |
| 6,210,275 | B1 | 4/2001 | Olsen |
| 6,248,016 | B1 | 6/2001 | Walker et al. |
| 6,257,979 | B1 | 7/2001 | Walker et al. |
| 6,311,978 | B1 | 11/2001 | Moody |
| 6,332,839 | B2 | 12/2001 | Walker et al. |
| 6,334,613 | B1 | 1/2002 | Yoseloff |
| 6,406,023 | B1 | 6/2002 | Rowe |
| 6,419,578 | B1 | 7/2002 | Moody et al. |
| 6,422,940 | B1 | 7/2002 | Walker et al. |
| 6,435,511 | B1 | 8/2002 | Vancura et al. |
| 6,457,715 | B1 | 10/2002 | Friedman |
| 6,474,645 | B2 | 11/2002 | Tarantino |
| 6,474,646 | B1 | 11/2002 | Webb |
| 6,491,302 | B1 | 12/2002 | Boylan et al. |
| 6,517,074 | B1 | 2/2003 | Moody et al. |
| 6,523,829 | B1 | 2/2003 | Walker et al. |
| 6,533,658 | B1 | 3/2003 | Walker et al. |
| 6,561,898 | B2 | 5/2003 | Moody |
| 6,568,680 | B1 | 5/2003 | Moody et al. |
| 6,569,014 | B2 | 5/2003 | Walker et al. |
| 6,592,456 | B2 | 7/2003 | Walker et al. |
| 6,599,193 | B2 | 7/2003 | Baerlocher et al. |
| 6,631,906 | B1 | 10/2003 | Timpano |
| 6,652,377 | B1 | 11/2003 | Moody |
| 6,672,959 | B2 | 1/2004 | Moody et al. |
| 6,726,427 | B2 | 4/2004 | Jarvis et al. |
| 6,729,961 | B1 | 5/2004 | Millerschone |
| 6,793,220 | B1 | 9/2004 | Feola |
| 6,811,153 | B1 | 11/2004 | Ko |
| 6,846,238 | B2 | 1/2005 | Wells |
| 6,916,245 | B1 | 7/2005 | Vancura et al. |
| 6,935,950 | B2 | 8/2005 | Tarantino |
| 6,955,356 | B2 | 10/2005 | Moody |
| 6,959,927 | B1 | 11/2005 | Jacobs et al. |
| 6,964,418 | B2 | 11/2005 | Moody |
| 6,969,316 | B2 | 11/2005 | Jarvis et al. |
| 6,986,514 | B2 | 1/2006 | Snow |
| 6,991,538 | B2 | 1/2006 | Cannon |
| 6,994,624 | B2 | 2/2006 | Gold et al. |
| 7,004,834 | B2 | 2/2006 | Walker et al. |
| 7,056,207 | B2 | 6/2006 | Walker et al. |
| 7,059,965 | B2 | 6/2006 | Jackson |
| 7,070,505 | B2 | 7/2006 | Vancura et al. |
| 7,137,628 | B2 | 11/2006 | Moody |
| 7,156,397 | B2 | 1/2007 | Moody et al. |
| 7,156,734 | B1 | 1/2007 | Walker et al. |
| 7,159,868 | B2 | 1/2007 | Webb |
| 7,195,244 | B1 | 3/2007 | Feola |
| 7,201,655 | B2 | 4/2007 | Walker et al. |
| 7,222,857 | B2 | 5/2007 | Moody |
| 7,222,858 | B2 | 5/2007 | Moody |
| 7,247,092 | B2 | 7/2007 | Jarvis |
| 7,297,057 | B2 | 11/2007 | Gerrard et al. |
| 7,297,059 | B2 | 11/2007 | Vancura et al. |
| 7,331,859 | B2 | 2/2008 | Hornik et al. |
| 7,354,344 | B2 | 4/2008 | Paulsen et al. |
| 7,357,716 | B2 | 4/2008 | Marks et al. |
| 7,387,568 | B2 | 6/2008 | Millerschone |
| 7,390,258 | B2 | 6/2008 | Millerschone |
| 7,393,276 | B2 | 7/2008 | Millerschone |
| 7,404,762 | B2 | 7/2008 | Moody |
| 7,416,186 | B2 | 8/2008 | Walker et al. |
| 7,419,162 | B2 | 9/2008 | Lancaster et al. |
| 7,431,644 | B2 | 10/2008 | Moody |
| 7,470,184 | B2 | 12/2008 | Baerlocher et al. |
| 7,476,542 | B2 | 1/2009 | Walker et al. |
| 7,488,251 | B2 | 2/2009 | Kaminkow |
| 7,524,243 | B2 | 4/2009 | Bansemer et al. |
| 7,568,973 | B2 | 8/2009 | Iddings et al. |
| 7,585,223 | B2 | 9/2009 | Iddings et al. |
| 7,597,621 | B2 | 10/2009 | Baerlocher |
| 7,601,060 | B2 | 10/2009 | Baerlocher et al. |
| 7,614,946 | B2 | 11/2009 | Nicely |
| 7,641,197 | B2 | 1/2010 | Jackson |
| 7,651,392 | B2 | 1/2010 | Pennington et al. |
| 7,658,672 | B1 | 2/2010 | Wolf et al. |
| 7,666,093 | B2 | 2/2010 | Lafky et al. |
| 7,666,094 | B2 | 2/2010 | Baerlocher et al. |
| 7,674,178 | B2 | 3/2010 | Baerlocher et al. |
| 7,674,179 | B2 | 3/2010 | Baerlocher et al. |
| 7,677,971 | B2 | 3/2010 | Baerlocher et al. |
| 7,677,972 | B2 | 3/2010 | Baerlocher et al. |
| 7,682,248 | B2 | 3/2010 | Baerlocher et al. |
| 7,713,120 | B2 | 5/2010 | Cannon |
| 7,748,714 | B2 | 7/2010 | Nicely et al. |
| 7,749,059 | B2 | 7/2010 | Tarantino |
| 7,749,061 | B2 | 7/2010 | Walker et al. |
| 7,753,784 | B2 | 7/2010 | Baerlocher |
| 7,771,274 | B2 | 8/2010 | Walker et al. |
| 7,780,520 | B2 | 8/2010 | Baerlocher |
| 7,780,523 | B2 | 8/2010 | Baerlocher et al. |
| 7,785,188 | B2 | 8/2010 | Cannon |
| 7,803,041 | B2 | 9/2010 | Gold et al. |
| 7,803,043 | B2 | 9/2010 | Jackson |
| 7,815,500 | B2 | 10/2010 | Montross et al. |
| 7,837,545 | B2 | 11/2010 | Blair, Jr. et al. |
| 7,841,939 | B2 | 11/2010 | Baerlocher et al. |
| 7,857,693 | B1 | 12/2010 | Johnson et al. |
| 7,862,417 | B2 | 1/2011 | Nicely |
| 7,867,073 | B2 | 1/2011 | Walker et al. |
| 7,867,080 | B2 | 1/2011 | Nicely et al. |
| 7,905,770 | B2 | 3/2011 | Snow |
| 7,905,778 | B2 | 3/2011 | Breckner et al. |
| 7,914,369 | B2 | 3/2011 | Walker et al. |
| 7,914,377 | B2 | 3/2011 | Benbrahim et al. |
| 7,918,724 | B2 | 4/2011 | Walker et al. |
| 7,922,571 | B2 | 4/2011 | Walker et al. |
| 7,942,737 | B2 | 5/2011 | Cregan et al. |
| 7,963,847 | B2 | 6/2011 | Baerlocher |
| 7,993,191 | B2 | 8/2011 | Evans et al. |
| 8,216,039 | B2 | 7/2012 | Nicely et al. |
| 8,221,214 | B2 | 7/2012 | Nicely |
| 8,235,780 | B2 | 8/2012 | Nicely |
| 2001/0028147 | A1 | 10/2001 | Ornstein et al. |
| 2002/0163129 | A1 | 11/2002 | Webb |
| 2003/0006555 | A1 | 1/2003 | Boylan et al. |
| 2003/0027626 | A1 | 2/2003 | Marks et al. |
| 2003/0030217 | A1 | 2/2003 | Webb |
| 2003/0114209 | A1 | 6/2003 | Ritner, Jr. et al. |
| 2003/0130024 | A1 | 7/2003 | Darby |
| 2004/0116179 | A1 | 6/2004 | Nicely et al. |
| 2005/0029742 | A1 | 2/2005 | Snow |
| 2005/0170875 | A1 | 8/2005 | Snow |
| 2005/0202863 | A1 | 9/2005 | Macaulay |
| 2006/0025213 | A1 | 2/2006 | Kane et al. |

(56) References Cited

U.S. PATENT DOCUMENTS

2006/0030403 A1 2/2006 Lafky
2006/0084505 A1 4/2006 Yoseloff et al.
2006/0135238 A1 6/2006 Lancaster et al.
2006/0183535 A1 8/2006 Marks et al.
2006/0226604 A1 10/2006 Saucier
2006/0244218 A1 11/2006 Frankel et al.
2007/0035091 A1 2/2007 Tang
2007/0054721 A1 3/2007 Jackson
2007/0060321 A1 3/2007 Vasquez et al.
2007/0114723 A1 5/2007 Webb
2007/0135193 A1 6/2007 Nicely
2007/0135194 A1 6/2007 Nicely et al.
2007/0170653 A1 7/2007 Brunelle et al.
2007/0184887 A1 8/2007 Cannon
2007/0191088 A1 8/2007 Breckner et al.
2008/0020815 A1 1/2008 Lancaster et al.
2008/0020846 A1 1/2008 Vasquez et al.
2008/0039191 A1 2/2008 Cuddy
2008/0064462 A1 3/2008 Gerrard et al.
2008/0070674 A1 3/2008 Lancaster et al.
2008/0076500 A1 3/2008 Lancaster et al.
2008/0090630 A1 4/2008 Yoshizawa
2008/0090651 A1 4/2008 Baerlocher
2008/0108430 A1 5/2008 Evans
2008/0111309 A1 5/2008 Nicely et al.
2008/0113704 A1 5/2008 Jackson
2008/0113779 A1 5/2008 Cregan
2008/0119257 A1 5/2008 Stern et al.
2008/0188278 A1 8/2008 Paulsen et al.
2008/0197571 A1 8/2008 Okada
2008/0207298 A1 8/2008 Marks et al.
2008/0214255 A1 9/2008 Jarvis et al.
2008/0254847 A1 10/2008 Millerschone
2009/0005144 A1 1/2009 Moody
2009/0042645 A1 2/2009 Graham et al.
2009/0088244 A1 4/2009 Nicely et al.
2009/0104962 A1 4/2009 Nicely et al.
2009/0111561 A1 4/2009 Dewaal et al.
2009/0121434 A1 5/2009 Baerlocher et al.
2009/0124313 A1 5/2009 Nicely
2009/0124316 A1 5/2009 Baerlocher et al.
2009/0124334 A1 5/2009 Jones et al.
2009/0124362 A1 5/2009 Cuddy et al.
2009/0124363 A1 5/2009 Baerlocher et al.
2009/0124364 A1 5/2009 Cuddy et al.
2009/0181743 A1 7/2009 Bansemer et al.
2010/0004051 A1 1/2010 Walker et al.
2010/0035676 A1 2/2010 Nicely et al.
2010/0099480 A1 4/2010 Caputo
2010/0117299 A1 5/2010 Nicely et al.
2010/0120484 A1 5/2010 Caputo et al.
2010/0120498 A1 5/2010 Cuddy et al.
2010/0120514 A1 5/2010 Caputo
2010/0144415 A1 6/2010 Wolf et al.
2010/0190546 A1 7/2010 Baerlocher et al.
2010/0197386 A1 8/2010 Lafky et al.
2010/0227661 A1 9/2010 Walker et al.
2010/0227677 A1 9/2010 Baerlocher
2010/0252997 A1 10/2010 Walker et al.
2010/0261524 A1 10/2010 Pawloski et al.
2010/0289220 A1 11/2010 Jackson
2010/0331068 A1 12/2010 Walker et al.
2011/0003625 A1 1/2011 Montross et al.
2011/0003637 A1 1/2011 LeFever
2011/0014963 A1 1/2011 Walker et al.
2011/0053676 A1 3/2011 Wolf et al.
2011/0111818 A1 5/2011 Baerlocher
2011/0111843 A1 5/2011 Nicely et al.
2011/0118011 A1 5/2011 Filipour et al.
2011/0183750 A1 7/2011 Cregan et al.
2011/0212768 A1 9/2011 Baerlocher

GAMING SYSTEM AND METHOD PROVIDING A CARD GAME ASSOCIATED WITH A SUPPLEMENTAL POOL FUNDED UPON AN OCCURRENCE OF A DESIGNATED OUTCOME AND WINNABLE BY A PLAYER OR A DEALER

COPYRIGHT NOTICE

A portion of the disclosure of this patent document contains or may contain material that is subject to copyright protection. The copyright owner has no objection to the photocopy reproduction by anyone of the patent document or the patent disclosure in exactly the form it appears in the Patent and Trademark Office patent file or records, but otherwise reserves all copyright rights whatsoever.

BACKGROUND

Blackjack games are extremely popular and well-known card games. Typically, a Blackjack game is associated with one or more standard decks of fifty-two playing cards. Each numbered card has a value that is equal to its face value; each Jack, Queen, and King has a value of ten; and each Ace has a value of either one or eleven, depending on which value is more beneficial. The dealer begins a play of the Blackjack game by dealing a hand of two cards to each player who has placed a wager. The dealer also deals a hand of two cards to himself or herself. One of the cards of the dealer's hand is dealt face up (called the "up card") and the other card of the dealer's hand is dealt face down (called the "down card"). Each hand has a count, which is equal to a sum of the values of the cards of that hand.

A player may draw one or more additional cards to add to the player's hand to increase the count of the player's hand. This is referred to as "hitting." If the count of the player's hand exceeds twenty-one following a "hit," however, then the player "busts," Once the player "busts," the player loses and the player's wager is forfeited regardless of whether the dealer "busts." The player can "stand" rather than "hit" when the count of the player's hand is twenty-one or less. In other words, "hitting" is optional for the player.

Each gaming establishment has house rules that govern how the Blackjack game is to be played and, in particular, when the dealer must "hit." House rules can vary from establishment to establishment or Blackjack game to Blackjack game. Usually, the dealer must "hit" when the count of the dealer's hand is less than seventeen. Some house rules require that a dealer "hit" when the dealer's hand includes an Ace and a Six (or an Ace and multiple additional cards having values adding up to six), known as a "soft" seventeen (because an Ace can have the value of either eleven or one). Normally, a dealer must "stand" on a "soft" eighteen, nineteen, or twenty.

If the dealer "busts," each player wins, regardless of that player's hand, unless that player has "busted." If the dealer does not "bust," for each player who did not "bust," that player wins if the count of that player's hand is closer to twenty-one than the count of the dealer's hand. That player loses if the count of the dealer's hand is closer to twenty-on than the count of that player's hand. If, however, the count of that player's hand and the count of the dealer's hand are equal, the play of the Blackjack game results in a "push," and the player's wager is returned to the player.

"Doubling down" is an optional procedure of a player doubling the player's original wager after the player's initial two cards are dealt, and then drawing a single additional card to add to the player's hand. The three-card hand becomes the player's final hand. In many gaming establishments, the house rules restrict this option, often allowing it only if the values of the player's first two cards total ten or eleven.

"Splitting" is an optional procedure of splitting a pair of cards having the same value dealt to a player into two hands by making an additional wager equal to the original wager. Each of these wagers is applied to a different one of the split hands. The player receives a new second card for each of the split hands, and each split hand is then played out separately. When "splitting" Aces, the player can usually receive only one additional card for each split hand, depending on the house rules.

"Insurance" is an optional procedure that is available when the dealer's "up card" is an Ace. After each player receives that player's first two cards and the dealer reveals the dealer's "up card," each player can wager one-half of the amount of that player's original wager as "insurance" against the dealer having a "Blackjack" (a two-card twenty-one count). If the dealer has a "Blackjack," the player loses the player's original wager and wins 2-to-1 on the insurance wager. On the other hand, if the dealer does not have a "Blackjack," the player loses the player's insurance wager and play continues with respect to the player's original wager.

"Surrender" is an optional procedure that varies according to house rules, but when allowed, permits a player to forfeit one-half of the player's wager after the player's first two cards are dealt and evaluated against the dealer's "up card."

In recent years, poker games have also become extremely popular. One common poker game is Pai Gow Poker. Pai Gow Poker is a variation of the Chinese domino game Pai Cow, and is played using playing cards rather than dominoes. Pai Gow Poker is typically played with a fifty-three card deck that includes fifty-two cards from a standard deck of playing cards and a single Joker. Pai Gow Poker is also typically played at a gaming table with a physical deck of cards and a live human dealer, though Pai Cow Poker can also be played on an electronic gaming machine (EGM) using electronic cards. Generally, in Pai Gow Poker, multiple players directly compete against a dealer. Each player attempts to form two high ranking hands from a set of seven initially dealt player cards.

More specifically, a round of play of the game begins after each of the players places an initial wager. Each player is dealt seven cards. After the cards have been dealt, each player views that player's cards and arranges that player's seven cards into a five-card player hand and a two-card player hand. For a player to win, both of the player's hands must beat both of the dealer's hands (as discussed below).

In Pai Gow Poker, a player's five-card hand is evaluated similarly to how five-card hands are evaluated in a standard game of Five Card Draw Poker, with a few exceptions discussed below. For the player's five-card hand, there are ten general categories or ranks of hands, ranked from highest to lowest, as shown in Table 1 below.

TABLE 1

Ranking of Five-card Poker Hands by Category

| Rank | Hand Type | Example |
|---|---|---|
| 1 | Royal Straight Flush | A♣ K♣ Q♣ J♣ 10♣ |
| 2 | Straight Flush | K♣ Q♣ J♣ 10♣ 9♣ |
| 3 | Four-of-a-Kind | J♣ J♥ J♦ J♠ 3♣ |
| 4 | Full House | A♥ A♦ A♣ 6♦ 6♣ |
| 5 | Flush | A♣ J♣ 8♣ 6♣ 2♣ |
| 6 | Straight | 8♦ 7♣ 6♠ 5♠ 4♣ |
| 7 | Three-of-a-Kind | Q♠ Q♥ Q♦ 6♦ 2♠ |
| 8 | Two Pair | 8♦ 8♥ 5♥ 5♣ 2♠ |

TABLE 1-continued

| Ranking of Five-card Poker Hands by Category | | |
|---|---|---|
| Rank | Hand Type | Example |
| 9 | One Pair | K♦ K♠ 8♣ 7♣ 2♥ |
| 10 | High Card | A♥ 10♣ 7♦ 5♠ 3♠ |

When comparing two five-card hands, the hand with the higher-ranking hand type wins. When the two hands have the same hand type, the stronger hand is determined relative to the card ranks making up each hand, with an Ace being the highest card and a Two being the lowest card. There is no difference in rank between the four card suits. All hands can be ranked in a linear ranking from highest to lowest. Because suits are all of the same value, however, there are multiple hands that have identical rankings. For example, a Straight Flush including 5♠ 6♠ 7♠ 8♠ 9♠ is equivalent to a straight flush of all the same ranks but of a different suit, such as 5♥ 6♥ 7♥ 8♥ 9♥.

For the One Pair, Three-of-a-Kind, and Four-of-a-Kind outcomes, the hand with the highest matching rank wins. For example, a Pair of Kings beats a Pair of Tens.

For a Two Pair outcome, the hand with the higher high Pair wins. For example, a hand including 3-3-8-8 beats a hand including 5-5-7-7, since the high Pair of Eights beats the high Pair of Sevens. If the high Pair is the same, then the low Pair is compared. For example, a hand including 5-5-J-J beats a hand including 3-3-J-J because the high Pair matches and the low Pair of Fives beats the low Pair of Threes.

For a Full House, the hand with the higher Three-of-a-Kind wins. For example, a hand including K-K-8-8-8 beats a hand including A-A-5-5-5 because the three Eights beat the three Fives.

When comparing Straight, Flush, or Straight Flush hands, the hand with the highest card rank wins. For example, a 7-8-9-10-J Straight beats a 6-7-8-9-10 Straight. In Pai Gow Poker, the highest Straight is a 10-J-Q-K-A. The second highest Straight is an A-2-3-4-5. The third highest straight is a 9-10-J-Q-K.

When comparing two Flush hands, the hand with the highest ranking card wins. If both hands have the same highest ranking card rank, then the next highest card ranks are compared. This is the same way that two High Card hands are compared.

If the winning outcomes are the same between two hands, then the remaining cards in the hand are examined. For example, a hand including 5-3-3-8-8 beats a hand including 4-3-3-8-8. While the high and low Pairs both match, the remaining Five beats the Four. Likewise, a hand including 4-9-J-8-8 beats a hand including 4-6-J-8-8. The Pair of Eights match, as do the high card Jacks. Looking at the next highest cards, however, the Nine beats the Six.

For the player's two-card hand, there are only two general categories or ranks of hands, ranked from highest to lowest, as shown in Table 1 below.

TABLE 2

| Ranking of Two-card Poker Hands by Category | | |
|---|---|---|
| Rank | Hand Type | Example |
| 1 | One Pair | A♣ A♦ |
| 2 | High Card | K♣ 9♥ |

Within each of the two categories, hands are ranked according to the rank of individual cards, with an Ace being the highest card and a Two being the lowest card. The highest ranking two-card Pai Cow Poker hand is a pair of Aces (A♥ A♠), and the lowest ranking hand includes a Two-Three combination (e.g., 2♦ 3♣).

In certain Pai Cow Poker games that include a Joker card, the Joker can only be used as a wild card to complete a Straight, a Flush, a Straight Flush, or a Royal Straight Flush. In the case of completing a Straight, a Flush or a Straight Flush, the Joker is assigned the highest rank possible within that context. For example, in the hand Joker Q♣ J♣ 10♣ 9♣, the Joker is evaluated as being a K♣ even though the Joker's evaluation as a 8♣ would also yield a Straight Flush. In a similar example, in the hand Joker A♣ J♣ 8♣ 6♣, the Joker is evaluated as being the largest rank available, which for his example would be the K♣. If a Joker cannot be used to complete a Straight, a Flush, a Straight Flush, or a Royal Straight Flush, the Joker is given the value of an Ace.

After each of the players has arranged the player's seven cards into a five-card player hand and a two-card player hand, the dealer arranges the seven dealer cards into a five-card dealer hand and a two-card dealer hand according to a set of rules commonly known as "House Way" rules. The "House Way" rules can vary from one gaming establishment to another, as described further below. For each of the players, after the dealer has arranged the set of seven dealer cards to form the five-card dealer hand and the two-card dealer hand, the dealer compares the five-card player hand to the five-card dealer hand and the two-card player hand to the two-card dealer hand. If both of the five-card player hand and two-card player hand beat the respective dealer hands, then the player wins an award. Under certain Pai Cow Poker house rules, if the player wins, the house may take a defined percentage of the player's award (known as a commission, a vigorish, or a "vig"). If both the dealer five-card hand and two-card hand beat the respective player hands, the player loses and the player's wager is forfeited. If one of the player's hands beats its respective dealer hand and the other one of the player's hands loses to its respective dealer hand, the player "pushes" on the round of play of the game and the player's wager is returned. In Pai Cow Poker, this type of a tie (i.e., one winning hand and one losing hand) occurs fairly often. If the rank of the five-card player hand is the same as the rank of the five-card dealer hand and if the rank of the two-card player hand is the same as the rank of the two-card dealer hand, the player loses the wager. This type of a tie-tie situation is sometimes referred to as a copy.

In Psi Gow Poker, there are several rules or restrictions that dictate how a player must form the player's five-card and two-card player hands. For example, the two-card player hand must rank lower than the five-card player hand. For example, if both the two-card hand and the five-card hand are of the type One Pair, the two-card hand is not allowed to have a higher ranking pair than the five-card hand. Similarly, if both the two-card hand and the five-card hand are of the hand type High Card, the two-card hand is not allowed to have a higher ranking high card than the five-card hand. However, if the five-card hand is of the hand type Two Pair and the two-card hand is of the hand type One Pair, the pair in the two-card hand can be of a higher rank than either pair within the five-card hand because the five-card hand is of a higher ranking hand type. If a player mistakenly sets the two-card player hand to have a higher rank than the five-card player hand (e.g., a five-card hand having only a High Card ranking, such as A♥ K♠ 9♥ 6♣ 4♦, and a two-card hand having a Pair, such as Q♥ Q♣), then both hands are determined to be "foul." When the game is offered on a physical table with a live dealer, certain gaming establishment rules will result in a "foul" hand automatically losing. When the game is offered on an EGM, the EGM typically warns the player of the attempt at setting a foul hand and prompts the player to correct the player's setting. In an EGM that supports multi-player play, a time limit may be established. If a given player is unable to set the player's hand within an allotted period of Lime, the EGM will set the player's hand on the player's behalf according to the House Way rules.

In certain gaming establishments, a player may request that the dealer set the player's hand according to house way rules. When the game is offered at a physical table with a live dealer, the setting of a player hand is typically handled as follows. A player places the cards face down in a single stack and announces to the dealer the desire for the dealer to set that hand. After all other players at the table have set their own hands, the dealer will assist any players requesting house setting one at a time. For a given player, the dealer will reveal that player's cards, set the cards according to the House Way rules, and then place the cards in the areas that the player would normally do so himself or herself. Casinos typically use this order of operation to prevent players from seeing any cards other than their own before setting theft own hands, as casinos are concerned that an expert player may be able to achieve an advantage against the casino if the player is able to deduce what cards the dealer holds by a process of elimination regarding revealed player cards.

Under certain Pai Gow Poker gaming configurations, a player may elect to act as the banker. When a player plays the role of the banker, the player competes against the other player or players at the table. If the player who is playing the role of banker wins, the player-banker wins an award and a commission based on the winnings is paid to the house. Under certain game rules, when a player is acting the role of banker, the dealer still participates in the game. In general, the opportunity for player to play the role of banker rotates around the table. Alternatively, the opportunity to play the role of the banker may alternate between player and dealer between each round of play. As mentioned above, however, the players may alternatively elect to decline this option. If a player elects to play the role of the banker, the player must have enough money to pay losses to the other players and the dealer assuming that the player/banker loses to all of the other players and the dealer.

One factor in determining a player's odds of beating the dealer (or other player-banker) is based upon the way in which a player arranges the player's cards to form the five-card player hand and the two-card player hand. That is, there are many ways that a player could set the player's cards without having "foul" hands, but there are card setting strategies that can optimize the player's probability of beating the dealer. In certain known Pai Gow Poker games, whether the games are operated on an EGM or dealt by a live human dealer, the games include the following characteristics: (a) the cards in the dealer hand are set according to a set of "House Way" rules, and (b) a player can either set their own cards according to the rules of the game or can request to have the dealer set the cards in the player's hand according to the "House Way" rules. In general, the "House Way" rules are not the same as optimal play rules, "House Way" rules are generally simplified rules relative to optimal play rules because the simplified rules are not overly complex and enable a human dealer to learn, remember, and execute simple rules to reduce the chance of dealer errors and to reduce the chance of player disputes.

The "House Way" rules can differ based on the preferences of the gaming establishment, local gaming regulations, regional customer preferences, and/or other factors. One example of a set of "House Way" rules for setting the dealer hands is outlined below. As mentioned above, the dealer receives seven cards and must divide the seven cards into a five-card dealer hand and a two-card dealer hand, where the five-card dealer hand must have a higher rank than the two-card dealer hand.

Under this example set of "House Way" rules, if the seven dealer cards do not include a pair (e.g., A♥, K♠, J♣, 8♥, 6♠, 4♦, and 3♣), the dealer must place the highest value card (A♥) in the five-card dealer hand and must place the next two highest cards (K♠ J♣) in the two-card dealer hand. A hand such as this, whether it be a player hand or a dealer hand, that does not include a pair or better is often referred to as a "Pai Cow." By placing the highest value card in the five-card dealer hand, the hands are not "foul." Moreover, even assuming that the dealer will lose the five-card dealer hand, placing the next two highest cards in the two-card dealer hand will maximize the probability that the dealer will win at least one of the two hands and tie the player(s) (i.e., a "push" outcome). Certain "House Way" rules are configured to maximize the probability that the dealer will tie the player (i.e., that the dealer will have one winning hand and one losing hand).

If the seven dealer cards include one pair (e.g., A♠, K♠, J♣, J♥, 6♠, 4♦, and 3♣), the dealer must place the pair (J♣ J♥) in the five-card dealer hand and the next two highest value cards (A♠ K♠) in the two-card dealer hand. In this example rule, the Ace and the King are more useful in the two-card dealer hand, and would not significantly affect or improve the rank of the five-card dealer hand.

If the seven dealer cards include two pairs, the dealer must place both of the pairs in the five-card dealer hand except in the following circumstances:

(a) if one of the pairs is Sevens or greater and there are no singleton Aces (i.e., a non-paired Ace), then place the higher pair in the five-card dealer hand and the lower pair in the two-card dealer hand;

(b) if one of the pairs is Jacks or better, if the other of the pairs is Sixes or better, and there is a singleton Ace, then place the higher pair in the five-card dealer hand and the lower pair in the two-card dealer hand; and (c) if one of the pairs is a pair of Aces, then place the pair of Aces in the five-card dealer hand and the lower pair in the two-card dealer hand. In this case, because the pair of Aces is already a high pair (and relatively high ranking five-card hand) the benefit of placing the lower pair in the two-card dealer hand exceeds the detriment of sacrificing a Two Pair hand as the five-card dealer hand.

If the seven dealer cards include three pairs (e.g., A♥, A♣, 10♥, 10♠, 6♣, 6♦, and J♥) always place the highest ranking pair (A♥ A♣) in the two-card dealer hand and place the remaining two pair (10♥ 10♠ and 6♣ 6♦) in the five-card dealer hand.

If the seven dealer cards include a Three-of-a-Kind, the dealer must place the Three-of-a-Kind in the five-card dealer hand unless the Three-of-a-Kind includes three Aces. If the Three-of-a-Kind includes Aces, place a pair of Aces in the five-card dealer hand, and place the third Ace in the two-card dealer hand.

If the seven dealer cards include a Full House (e.g., K♠, K♦, K♣, 4♦, 4♠, 9♦ and 7♣), the dealer must split the Rill House into a Three-of-a-Kind (K♠, K♦, K♣) and a pair (4♦, 4♠) with the Three-of-a-Kind being placed in the five-card dealer hand. This rule has the following exceptions:

(a) if the Full House include a pair of Twos, the Full House does not need to be split up; and (b) if the remaining two-cards of the seven dealer cards are an Ace and a King, the Full House does not need to be split up.

If the seven dealer cards include a Full House with a Three-of-a-Kind and two pairs (e.g., K♠, K♦, K♣, 4♦, 4♠, 9♦, and 9♣), the dealer must place the higher of the two pairs (i.e., 9▲ 9♣) in the two-card dealer hand. In this example hand, a Full House is likely to beat most five-card player hands. Therefore, the marginal benefit of having a higher pair in the five-card dealer hand is less than the marginal benefit of having a higher pair in the two-card dealer hand. In a single deck game having only four Kings, it would not be possible for another player to be dealt three Kings because the deck includes only one remaining King. Therefore, because no other player could be dealt a Full House including three Kings, there is no marginal benefit to having a higher second pair in the five-card dealer hand.

If the seven dealer cards include two separate Three-of-a-Kinds (e.g., J♥, J♦, J♣, 2♥, 2♠, 2♣, 6♦), the higher ranking of the two Three-of-a-Kinds (i.e., J♥, J♦, J♣) should be split up and the pair of Jacks should be placed in the two-card dealer hand. In the example above, the final five-card dealer hand would include 2♥ 2♠ 2♣ J♥ 6♦, and the final two-card dealer hand would include J♦ J♣. Because a Three-of-a-Kind is a relatively high ranking hand, the marginal benefit of having a higher ranking pair (e.g., J♥ J♦ instead of 2♥ 2♠) is greater than the marginal benefit of having a higher valued Three-of-a-Kind. Moreover, the marginal benefit of forming a Full House in the five-card dealer hand (e.g., J♥, J▲ J♣ 2♠) is not high enough to forego forming a pair in the two-card dealer hand.

If the seven dealer cards include a Straight, a Flush, a Straight Flush, or a Royal Straight Flush, the dealer uses these five cards in the five-card dealer hand except in the following circumstances in which the seven dealer cards also include two pairs:

(a) if the seven dealer cards include an Ace singleton (e.g., the following hand includes Two Pair, a Hearts Flush, and an Ace singleton: A♥ K♥ K♦ 10♥ 10♣ 9♥ 3♥);

(b) if the seven dealer cards include a pair of Jacks and a pair of Sixes (e.g., A♥ J♥ J▲ 6♥ 6♣ 9♥ 3♥); and (c) if the seven dealer cards include a pair of Aces and any other pair (A♥ A♦ K♥ 10♥ 8♥ 3♦ 3♥.

If the seven dealer cards include a six or seven card Straight or Flush (e.g., K♥ Q♥ J▲ 4♣ 9♣ 8♥ 7♥), form the highest possible two-card dealer hand (K♥ Q♥) while maintaining the Straight or Flush in the five-card dealer hand (J♦ 10♣ 9 ♣ 8♥ 7♥). If the seven dealer cards include a Straight Flush (e.g., J♥ 10♥ 9♥ 8♥ 7♥ 4♥ 2♣), form only a Straight or Flush in the five-card dealer hand if the two-card dealer hand can be made to include a Jack or higher. In the example above, the five-card dealer hand should be set to include a Flush (10♥ 9♥ 8♥ 7♥ 4♥), and the two-card dealer hand should be set to include the J♥ and 2♣. If the seven dealer cards include a Royal Straight Flush (e.g., A♥ K♥ A♥ J♥ 10♥ 6♥ 2♣), form only a Straight or Flush in the five-card dealer hand if the two-card dealer hand can be made to include an Ace or higher. In the example above, the five-card dealer hand should be set to include a Flush (K♥ Q♥ J♥ 10♥ 6♥), and the two-card dealer hand should be set to include the A♥ and 2♣.

If the seven dealer cards include a Four-of-a-Kind, whether to split the Four-of-a-Kind into two separate pairs is determined according to the rank of the Four-of-a-Kind as follows:

(a) if the rank is a Two through Six (e.g., 4♥ 4♦ 4♠ 4♣ J♥ 10♠ 2♥), always keep the Four-of-a-Kind together;

(b) if the rank is Seven through Ten, split the Four-of-a-Kind into two pairs unless an Ace or better can be played in the two-card dealer hand;

(c) if the rank is a Jack through King, split the Four-of-a-Kind into two pairs unless the hand also includes a pair of Tens or higher (e.g., the Four-of-a-Kind in the following hand should not be split: J♥ J♦ J♠ J♣ 10♥ 10 ♠ 2♥); and (d) if the rank is Aces, split unless the seven dealer cards also include a pair of Sevens or higher (e.g., the Four-of-a-Kind in the following hand should not be split: A♥ A♦ A♠ A♣ 7♥ 7♠ 2♥).

Finally, if the seven dealer cards include five Aces, split the five Aces up (i.e., three Aces in the five-card dealer hand and two Aces in the two-card dealer hand) unless a pair of Kings can be played in the two-card dealer hand (e.g., the five Aces in the following hand should not be split: A♥ A♦ A♠ A ♣ A♥ K♠ K♥).

As mentioned above, although the above example of "House Way" rules has been explained, the "House Way" rules can differ from gaming establishment to gaming establishment. For instance, in a second example of "House Way" rules, the rules for splitting Two Pair differ slightly from the first example of "House Way" rules described above. In this second example set of "House Way" rules, if the seven dealer cards include Two Pair, the pairs are split except in the following situations:

(a) if both of the pairs are of a rank of six or less;

(b) if both of the pairs are of a rank of ten or less and there is an Ace singleton; and (c) if one pair is a rank of Jack or greater, one pair is a rank of five or less, and there is an Ace singleton.

Certain players seek out variations to card games such as Blackjack and Pai Gow Poker. A continuing need thus exists for gaming systems and methods that provide new, exciting, and engaging card games.

SUMMARY

The present disclosure is directed to a gaming system and method providing a card game associated with a supplemental pool funded upon an occurrence of a designated outcome and winnable by a player or a dealer. Generally, the gaming system funds the supplemental pool with an amount of credits when the outcome of a play of the card game includes the designated outcome. The gaming system provides the player with the supplemental pool when a supplemental pool payout condition is met in association with play of the card game, and the gaming system resets a value of the supplemental pool to an initial value when a supplemental pool reset condition other than the player winning the supplemental pool is met in association with play of the card game. In other words, the dealer or the "house" wins the supplemental pool when the supplemental pool reset condition is met.

More specifically, in various embodiments, the gaming system is configured to operate a card game associated with a plurality of cards. For a play of the card game, the gaming system receives a wager from a player. The gaming system determines a plurality of player cards from the plurality of cards and displays the player cards face up. The gaming system determines a plurality of dealer cards from the plurality of cards and displays at least one of the dealer cards face up. The gaming system determines an outcome of the play of the card game based on a comparison of the player cards and the dealer cards. If the determined outcome is a designated outcome, the gaming system funds a supplemental pool with an amount of credits. In various embodiments, the amount of credits used to fund the supplemental pool includes one or more of: (a) at least part of the player's wager on the play of the card game; (b) the player's entire wager on the play of the card game; (c) an amount equal to any portion of the player's wager added to the supplemental pool, which is provided by the "house"; and (d) the commission, vigorish, or "vig" deducted from a player's award. If a supplemental pool payout condition is met, the gaming system provides the supplemental pool to the player. If a supplemental pool reset condition other than the player winning the supplemental pool is met, the gaming system resets a value of the supplemental pool to an initial value.

In one embodiment, the card game is a Blackjack game associated with a plurality of cards. Each of the cards is associated with one of a plurality of different values. In this embodiment, for a play of the Blackjack game, the gaming system receives a wager from a player. The gaming system determines a plurality of player cards from the plurality of cards and displays the player cards face up. The gaming system determines a plurality of dealer cards from the plurality of cards and displays at least one of the dealer cards face up. The gaming system enables the player to form a final player hand including at least the player cards, and determines a count of the final player hand by summing the values of the cards in the final player hand. The gaming system forms a final dealer hand including at least the dealer cards and determines a count of the final dealer hand by summing the values of the cards in the final dealer hand. The gaming system displays the cards of the final dealer hand face up. If the count of the final player hand is greater than the count of the final dealer hand, the gaming system provides an award to the player.

If the count of the final dealer hand is greater than the count of the final player hand, the gaming system ends the play of the Blackjack game. If the count of the final player hand is equal to the count of the final dealer hand, the gaming system funds the supplemental pool with an amount of credits including at least part of the received wager. If a supplemental pool payout condition is met, the gaming system provides the supplemental pool to the player. If a supplemental pool reset condition other than the player winning the supplemental pool is met, the gaming system resets a value of the supplemental pool to an initial value.

In one example, the supplemental pool reset condition is met when the dealer has won each of a first designated quantity of consecutive plays of the Blackjack game and the supplemental pool payout condition is met when the player has won each of a second designated quantity of consecutive plays of the Blackjack game. In this example, the first designated quantity is greater than the second designated quantity.

In another embodiment, the card game is a Pai Gow Poker game associated with a plurality of cards. In this embodiment, for a play of the Pai Gow Poker game, the gaming system receives a wager from a player. The gaming system determines a plurality of player cards from the plurality of cards and displays the player cards face up. The gaming system determines a rank of the player cards and provides the player a supplemental pool if the rank of the player cards is less than or equal to a first designated rank. The gaming system enables the player to form a first player hand and a second player hand from the player cards. The gaming system determines a plurality of dealer cards from the plurality of cards and displays the dealer cards face up. The gaming system forms a first dealer hand and a second dealer hand from the dealer cards. The gaming system determines a rank of the dealer cards and resets a value of the supplemental pool to an initial value if the rank of the dealer cards is less than or equal to a second designated rank.

If a rank of the first player hand is higher than a rank of the first dealer hand and a rank of the second player hand is higher than a rank of the second dealer hand, the gaming system provides an award to the player. If the rank of the first dealer hand is higher than the rank of the first player hand and the rank of the second dealer hand is higher than the rank of the second player hand, the gaming system ends the play of the Pai Gow Poker game. If one of: (i) the rank of the first player hand is higher than the rank of the first dealer hand and the rank of the second dealer hand is higher than the rank of the second player hand, and (ii) the rank of the first dealer hand is higher than the rank of the first player hand and the rank of the second player hand is higher than the rank of the second dealer hand, the gaming system funds the supplemental pool with an amount of credits including at least part of the received wager.

In one example, the first designated rank and the second designated rank are the same. In this example, the first designated rank and the second designated rank are a King-high Pai Gow.

Thus, in various embodiments, the gaming system of the present disclosure is configured to provide new, exciting, and engaging variations of card games, thereby increasing player enjoyment and entertainment.

Additional features and advantages are described herein, and will be apparent from, the following Detailed Description and the Figures.

DETAILED DESCRIPTION

Card Game Associated with a Supplemental Pool Funded Upon an Occurrence of a Designated Outcome and Winnable by a Player or a Dealer Various embodiments of the present disclosure are directed to a gaming system and method providing a card game associated with a supplemental pool funded upon an occurrence of a designated outcome and winnable by a player or a dealer. While the card game is a primary wagering game in the embodiments described below, it should be appreciated that the card game of the present disclosure may additionally or alternatively be employed as or in association with a secondary game or a bonus game. Moreover, while the player's credit balance, the player's wager, and any awards are displayed as an amount of monetary credits or currency in the embodiments described below, one or more of such player's credit balance, such player's wager, and any awards provided to such player may be for non-monetary credits, promotional credits, and/or player tracking points or credits.

While the embodiments of the card game described below are described as being operated on a gaming system, such as an EGM, it should be appreciated that the card game of the present disclosure may be provided at a physical card table. In certain such embodiments, the card game is dealt by a human dealer using physical playing cards. In other such embodiments, the card game is provided at a "smart table" that employs a display device (such as a display device including a touch screen, as further described below) for each player that is configured to display electronic playing cards.

Figure 1:
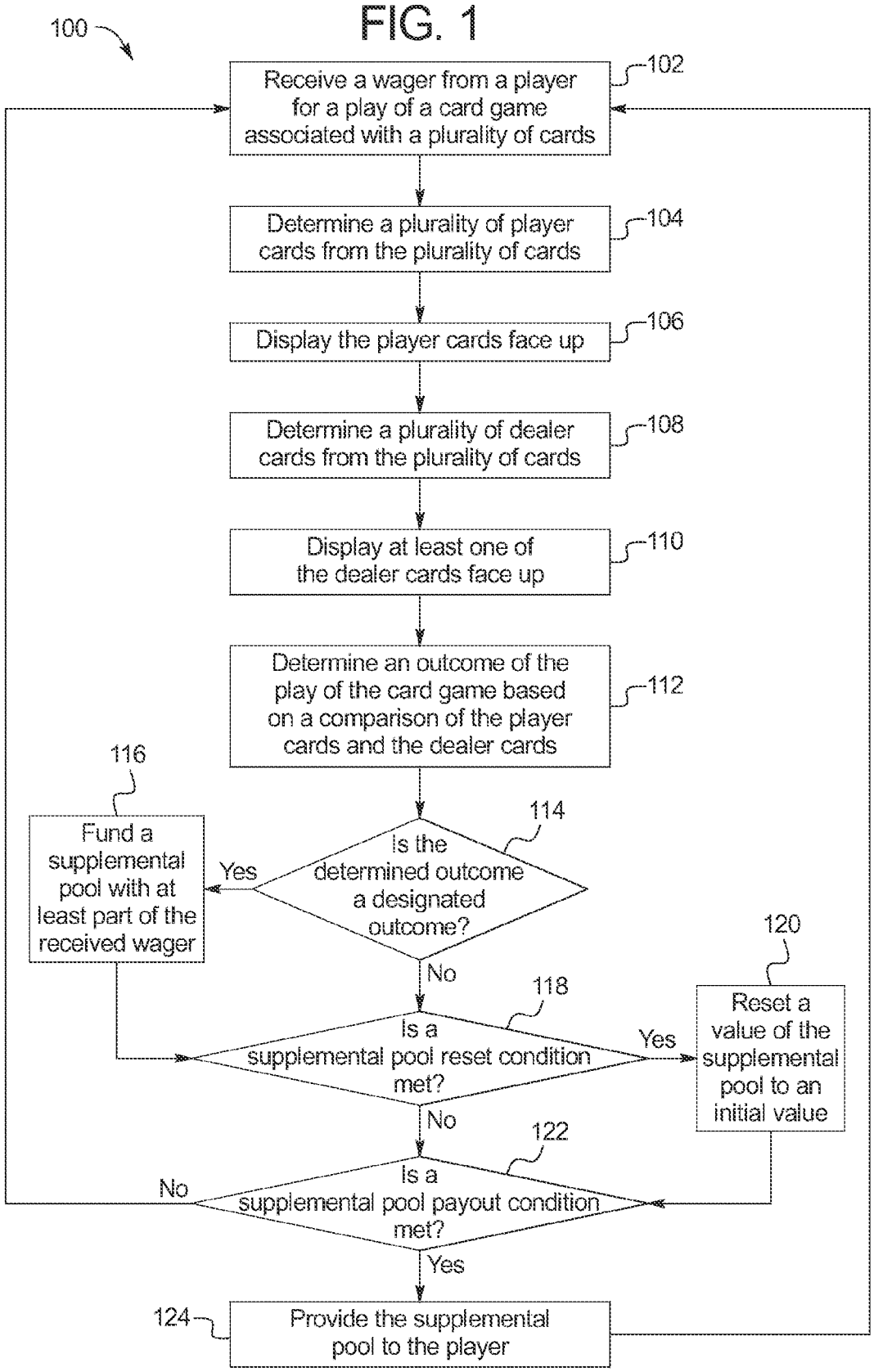
FIG. 1 is a flowchart illustrating an example method of operating the gaming system of the present disclosure.

FIG. 1 illustrates a flowchart of an example process or method 100 of operating the gaming system of the present disclosure. In various embodiments, process 100 is represented by a set of instructions stored in one or more memories and executed by one or more processors. Although process 100 is described with reference to the flowchart shown in FIG. 1, it should be appreciated that many other processes of performing the acts associated with this illustrated process may be employed. For example, the order of certain of the illustrated blocks and/or diamonds may be changed, certain of the illustrated blocks and/or diamonds may be optional, and/or certain of the illustrated blocks and/or diamonds may not be employed.

In this example, the gaming system is configured to operate a card game associated with a plurality of cards. For a play of the card game, the gaming system receives a wager from a player, as indicated by block 102. The gaming system determines a plurality of player cards from the plurality of cards, as indicated by block 104. The gaming system displays the player cards face up, as indicated by block 106. The gaming system determines a plurality of dealer cards from the plurality of cards, as indicated by block 108. The gaming system displays at least one of the dealer cards face up, as indicated by block 110. The gaming system determines an outcome of the play of the card game based on a comparison of the player cards and the dealer cards, as indicated by block 112.

The gaming system determines whether the determined outcome is a designated outcome, as indicated by diamond 114. If the gaming system determines that the determined outcome is not the designated outcome, process 100 proceeds to diamond 118, described below. If the gaming system instead determines that the determined outcome is the designated outcome, the gaming system funds a supplemental pool with at least part of the received wager, as indicated by block 116.

The gaming system determines whether a supplemental pool reset condition other than the player winning the supplemental pool is met, as indicated by diamond 118. If the gaming system determines that the supplemental pool reset condition is not met, process 100 proceeds to diamond 122, described below. If the gaming system instead determines that the supplemental pool reset condition is met, the gaming system resets a value of the supplemental pool to an initial value, as indicated by block 120. The gaming system determines whether a supplemental pool payout condition is met, as indicated by diamond 122. If the gaming system determines that the supplemental pool payout condition is not met, process 100 returns to block 102. If the gaming system instead determines that the supplemental pool payout condition is met, the gaming system provides the supplemental pool to the player, as indicated by block 124, and process 100 returns to block 102.

It should be appreciated that the designated outcome may be any suitable outcome. In one embodiment, the designated outcome is an outcome in which the player wins (e.g., the player's hand count is greater than the dealer's hand count in a Blackjack game or both player hands beat their respective dealer hands in a Pai Cow Poker game). In another embodiment, the designated outcome is an outcome in which the player loses (e.g., the player's hand count is less than the dealer's hand count in a Blackjack game or both dealer hands beat their respective player hands in a Pai Cow Poker game). In a further embodiment, the designated outcome is an outcome in which the player ties the dealer (e.g., the player's hand count matches the dealer's hand count in a Blackjack game or one of the player hands beats its respective dealer hand and the other one of the player hands loses to its respective dealer hand in a Pai Cow Poker game).

It should also be appreciated that, when the outcome of the play of the card game is the designated outcome, the gaming system funds the supplemental pool using any suitable portion of the received wager. In one embodiment, the gaming system funds the supplemental pool with the entire received wager. In another embodiment, the gaming system funds the supplemental pool with half of the received wager. In further embodiments, the gaming system funds the supplemental pool with any suitable percentage of the received wager. In certain embodiments, the gaming system funds the supplemental pool with additional value (e.g., credits or currency) in addition to funding the supplemental pool with all or part of the received wager. In one embodiment, the gaming system also funds the supplemental pool with an amount of credits equal to the portion of the received wager used to fund the supplemental pool. For example, the gaming system funds the supplemental pool with an entire received wager of 10 credits, and also funds the supplemental pool with an additional 10 credits (i.e., a match of the 10 credits already used to fund the supplemental pool) such that the value of the supplemental pool increases by 20 credits. In another example, the gaming system funds the supplemental pool with half of a received 10 credit wager, and also funds the supplemental pool with an additional 5 credits (i.e., a match of the 5 credits already used to fund the supplemental pool) such that the value of the supplemental pool increases by 10 credits.

In certain embodiments in which the designated outcome is a "push" outcome, the gaming system does not return any portion of the player's wager used to fund the supplemental pool to the player. For example, if the player places a 10 credit wager on a play of a blackjack game and the outcome of that play of the blackjack game is a "push," the gaming system funds the supplemental pool with the player's 10 credit wager and does not return the player's 10 credit wager to the player like in certain known blackjack games.

In certain embodiments in which the card game is a Pai Cow Poker game, the commission, vigorish, or "vig" is not provided to the "house" when a player wins. Rather, the commission, vigorish, or "vig" is used to fund the supplemental pool.

In certain embodiments, the gaming system displays a value of the supplemental pool, while in other embodiments, the gaming system does not display the value of the supplemental pool such that the supplemental pool is a "mystery" or "unknown" supplemental pool.

It should further be appreciated that the supplemental pool payout condition may be met upon an occurrence of any suitable event. In various embodiments, the supplemental pool payout condition is met when: (a) the player wins a designated quantity of consecutive plays of the card game; (b) the player loses a designated quantity of consecutive plays of the card game; (c) the player ties a designated quantity of consecutive plays of the card game; (d) the player does not lose (e.g., achieves either a winning outcome or a tie outcome) for a designated quantity of consecutive plays of the card game; (e) the player cards form a designated hand or combination (e.g., a "natural" blackjack; a "natural" suited blackjack; a "natural" color matching blackjack; a "natural" blackjack including a Jack and an Ace of any suit; a Five. Six, or Seven Card Charlie (i.e., a non-busting blackjack hand including five, six, or seven cards); a King-high Pai Cow or worse; or any other suitable hand); (f) the player cards include a bonus card or trigger; (g) the player is dealt two Aces in a Blackjack game; (h) the player is the first to achieve a certain outcome for a play of the card game after a designated quantity of plays of the card game have occurred following the supplemental pool reset condition being met (e.g., the player is the first to achieve a blackjack after ten plays of the card game have been played following the supplemental pool reset condition being met); (i) the player is the first to achieve a certain outcome for a play of the card game after the supplemental pool has reached a designated value (e.g., the player is the first to achieve a blackjack after the supplemental pool reaches 100 credits); (j) the player achieves a highest quantity of a certain outcome within a designated quantity of plays of the card game or before the supplemental pool reaches a designated value (e.g., the player achieves the most blackjacks within a ten play span or before the supplemental pool reaches 100 credits); (k) a certain outcome is not achieved by the dealer within a designated quantity of plays of the card game or before the supplemental pool reaches a designated value; (l) the player achieves a certain hand of cards, such as a hand of 7-7-7 in a blackjack game or a two-card hand of Ace-Ace in a Pai Cow poker game; (m) the player achieves a hand including a designated quantity of cards and having a certain player hand count in a blackjack game; (n) the player achieves a hand including at least a designated quantity of cards having a certain player hand count in a blackjack game; (o) the player achieves a hand including at most a designated quantity of cards having at most a certain player hand count in a blackjack game; (p) the player achieves a hand in which all of the cards share the same suit; (q) the player achieves a hand including at least one card of each different suit; (r) the player achieves a five card hand of a certain ranking; (s) the player achieves a five card hand of at least a certain ranking; (t) the player achieves a hand of a certain ranking including a Joker card; (u) the player achieves a hand of a certain ranking without a Joker card; (v) the player achieves a seven card hand of at least a designated ranking in a Pai Gow poker game (e.g., a hand including three pairs); (w) the player achieves a hand having a hand count of at least a certain value (such as 20) and the dealer achieves a hand having a hand count of less than or equal to a certain value (such as 17) in a blackjack game; (x) the player achieves a five-card hand having at least a certain rank and the dealer achieves a five-card hand achieving less than or equal to a certain rank in a Pai Gow poker game; (y) the player achieves a five-card hand having at least a certain rank and the dealer achieves a five-card hand achieving the same rank in a Pai Gow poker game; (z) the difference between the player hand count and the dealer hand count in a blackjack game is at least a designated value; and (aa) the difference between a ranking of the player's five-card hand in a Pai Gow game is at least a designated quantity of rankings better than a ranking of the dealer's five-card hand.

It should be appreciated from the above examples that, in certain embodiments, a player may take action that is negative or detrimental to the player's play of the card game to attempt to win the supplemental pool. In one example, the supplemental pool payout condition is met when the player loses a designated quantity of consecutive plays of the card game. Thus, in this example, a player may intentionally attempt to lose the designated quantity of consecutive plays of the card game to win the supplemental pool.

In various embodiments, the card game is associated with a plurality of different supplemental pool payout conditions. In these embodiments, when one of the supplemental pool payout conditions is met, the gaming system provides at least part of the supplemental pool to the player. In one example in which the card game is a Blackjack game, the gaming system includes: (a) a first supplemental pool payout condition that is met when the player cards form a non-color matching blackjack, (b) a second supplemental pool payout condition that is met when the player cards form a color matching blackjack, and (c) a third supplemental pool payout condition that is met when the player cards form a suit matching blackjack. In this example, when the first supplemental pool payout condition is met, the gaming system provides 25% (or any suitable percentage) of the supplemental pool to the player; when the second supplemental pool payout condition is met, the gaming system provides 50% (or any suitable percentage) of the supplemental pool to the player; and when the third supplemental pool payout condition is met, the gaming system provides 100% (or any suitable percentage) of the supplemental pool to the player. It should be appreciated that the card game may be associated with any suitable quantity of supplemental pool payout conditions.

It should further be appreciated that the supplemental pool reset condition may be met upon an occurrence of any suitable event other than the player winning the supplemental pool. In various embodiments, the supplemental pool reset condition is met when: (a) the dealer wins a designated quantity of consecutive plays of the card game; (b) the dealer loses a designated quantity of consecutive plays of the card game; (c) the dealer ties a designated quantity of consecutive plays of the card game; (d) the dealer does not lose (e.g., achieves either a winning outcome or a tie outcome) for a designated quantity of consecutive plays of the card game; (e) the dealer cards form a designated hand or combination (e.g., a "natural" blackjack; a "natural" suited blackjack; a "natural" color matching blackjack; a "natural" blackjack including a Jack and an Ace of any suit; a Five, Six, or Seven Card Charlie (i.e., a non-busting blackjack hand including five, six, or seven cards); a King-high Pai Cow or worse; or any other suitable hand); (f) the dealer cards include a bonus card or trigger; (g) the dealer is dealt two Aces in a Blackjack game; (h) the dealer is the first to achieve a certain outcome for a play of the card game after a designated quantity of plays of the card game have occurred following the supplemental pool reset condition being met (e.g., the dealer is the first to achieve a blackjack after ten plays of the card game have been played following the supplemental pool reset condition being met); (i) the dealer is the first to achieve a certain outcome for a play of the card game after the supplemental pool has reached a designated value (e.g., the dealer is the first to achieve a blackjack after the supplemental pool reaches 100 credits); (j) the dealer achieves a highest quantity of a certain outcome within a designated quantity of plays of the card game or before the supplemental pool reaches a designated value (e.g., the dealer achieves the most blackjacks within a ten play span or before the supplemental pool reaches 100 credits); (k) a certain outcome is not achieved by any of the players within a designated quantity of plays of the card game or before the supplemental pool reaches a designated value; (l) the dealer achieves a certain hand of cards, such as a hand of 7-7-7 in a blackjack game or a two-card hand of Ace-Ace in a Pai Cow poker game; (m) the dealer achieves a hand including a designated quantity of cards and having a certain dealer hand count in a blackjack game; (n) the dealer achieves a hand including at least a designated quantity of cards having a certain dealer hand count in a blackjack game; (o) the dealer achieves a hand including at most a designated quantity of cards having at most a certain dealer hand count in a blackjack game; (p) the dealer achieves a hand in which all of the cards share the same suit; (q) the dealer achieves a hand including at least one card of each different suit; (r) the dealer achieves a five card hand of a certain ranking; (s) the dealer achieves a five card hand of at least a certain ranking; (t) the dealer achieves a hand of a certain ranking including a Joker card; (u) the dealer achieves a hand of a certain ranking without a Joker card; (v) the dealer achieves a seven card hand of at least a designated ranking in a Pai Cow poker game (e.g., a hand including three pairs); (w) the dealer achieves a hand having a hand count of at least a certain value (such as 20) and the player achieves a hand having a hand count of less than or equal to a certain value (such as 17) in a blackjack game; (x) the dealer achieves a five-card hand having at least a certain rank and the player achieves a five-card hand achieving less than or equal to a certain rank in a Pai Cow poker game; (y) the dealer achieves a five-card hand having at least a certain rank and the player achieves a five-card hand achieving the same rank in a Pai Cow poker game; (z) the difference between the dealer hand count and the player hand count in a blackjack game is at least a designated value; and (aa) the difference between a ranking of the dealer's five-card hand in a Pai Cow game is at least a designated quantity of rankings better than a ranking of the player's five-card hand.

In certain embodiments, the card game is associated with a plurality of different supplemental pool reset conditions. In these embodiments, when one of the supplemental pool reset conditions is met, the gaming system removes at least part of the supplemental pool. In one example in which the card game is a Blackjack game, the gaming system includes: (a) a first supplemental pool reset condition that is met when the dealer cards form a non-color matching blackjack, (b) a second supplemental pool reset condition that is met when the dealer cards form a color matching blackjack, and (c) a third supplemental pool reset condition that is met when the dealer cards form a suit matching blackjack. In this example, when the first supplemental pool reset condition is met, the gaming system removes 25% (or any suitable percentage) of the supplemental pool; when the second supplemental pool reset condition is met, the gaming system removes 50% (or any suitable percentage) of the supplemental pool; and when the third supplemental pool reset condition is met, the gaming system resets the supplemental pool to an initial value. It should be appreciated that the card game may be associated with any suitable quantity of supplemental pool reset conditions.

Although the supplemental pool reset condition is different than the player winning the supplemental pool, it should be appreciated that; in certain embodiments, the gaming system resets the value of the supplemental pool to the initial value after providing the player the supplemental pool after the supplemental pool payout condition is met.

In certain embodiments, the probability that the supplemental pool payout condition will be met is greater than the probability that the supplemental pool reset condition will be met. That is, in these embodiments, it is relatively easier for the player to win the supplemental pool than it is for the dealer to win the supplemental pool. In other embodiments, the probability that the supplemental pool payout condition will be met is less than the probability that the supplemental pool reset condition will be met. That is, in these embodiments, it is relatively easier for the dealer to win the supplemental pool than it is for the player to win the supplemental pool. In further embodiments, the probability that the supplemental pool payout condition will be met is equal to the probability that the supplemental pool reset condition will be met. That is, in these embodiments, it is equally likely that the player or the dealer will win the supplemental pool.

In various embodiments, the gaming system funds the supplemental pool with additional credits (or, in certain embodiments, decreases the value of the supplemental pool by removing credits from the supplemental pool) upon an occurrence of one or more supplemental pool funding (or removal) events. For example, a supplemental pool funding (or removal) event occurs when one or more of: (a) gaming system provides the player a jackpot award, progressive award, or other designated award; (b) a total quantity of plays of the card game played by the player during a gaming session reaches a designated quantity of plays; (c) the gaming system receives a deposit of value to fund the gaming system at least a designated quantity of times during a gaming session; (d) a total amount wagered by the player during a gaming session reaches a designated amount wagered; (e) a total amount of credits or currency won by the player during a gaming session reaches a designated amount won; (f) a total amount of credits or currency lost by the player during a gaming session reaches a designated amount lost; (g) a time of day reaches a designated time of day; (h) a length of a gaming session reaches a designated length of time; (i) a play of a bonus game has not been provided within a designated amount of time during a gaming session; (j) a play of a bonus game has not been provided within a designated quantity of plays of the card game during a gaming session; (k) the player achieves a designated quantity of consecutive winning outcomes during a gaming session; (l) one or more designated events occur; (m) the player achieves a designated quantity of consecutive losing outcomes during a gaming session; (n) a total quantity of winning outcomes achieved by the player during a gaming session reaches a designated quantity; (o) a total quantity of losing outcomes achieved by the player during a gaming session reaches a designated quantity; (p) a total quantity of coin-in during a gaming session reaches a designated quantity; (q) a credit balance of the player reaches a designated credit balance; (r) a total amount of currency deposited by the player during a gaming session reaches a designated amount; (s) a change in frequency of play reaches a designated amount; (t) a ticket, coupon, or promotion is inserted or otherwise entered (such as by typing in a promotion code or scanning a barcode); (u) a designated quantity of credits is transferred onto the gaming system; (v) player tracking points are converted into one or more credits; (w) merchandise is purchased on the gaming system (such as through the use of player tracking points); (x) a contribution is made to charity through the use of the gaming system; (y) an update is posted onto a social networking website; (z) a status is changed on a social networking website; and (aa) a gaming establishment (such as a casino) is liked or shared via a social networking website.

In one embodiment, the gaming system requires the player to place a side wager or pay a fee in addition to any placed wagers to enable the supplemental pool to be funded and/or to enable the player to win the supplemental pool, That is, in this embodiment, if the player does not place the side wager or pay the fee in addition to any placed wagers, the gaming system does not fund the supplemental pool or enable the player to win the supplemental pool.

In certain embodiments, the gaming system activates or provides one or more rules that are favorable to the player in addition to enabling the player to win the supplemental pool. In one example in which the card game is a Blackjack game, the gaming system enables the player to hit split Aces, re-split Aces, hit more than once on a split Ace, and/or split more than once. In another example in which the card game is a Pai Cow Poker game, the gaming system provides the player an optimal automatic hand setting option that, if selected, causes the gaming system to automatically set the player's five-card and two-card hands in an optimal manner, as generally described in U.S. Pat. No. 8,216,039.

In certain embodiments, for a given player, the supplemental pool persists from play to play and gaming session to gaming session until either the player wins the supplemental pool (when the supplemental pool payout condition is met) or the supplemental pool is reset to the initial value (when the supplemental pool reset condition is met). For instance, if a player terminates a gaming session when the supplemental pool is 120 credits, the next time the player initiates a gaming session the supplemental pool will include 120 credits. In one example, the gaming system stores the value of the supplemental pool upon termination of a gaming session in association with the player's player tracking account.

In other embodiments, for a given player, the supplemental pool persists from play to play but not from gaming session to gaming session. In one such embodiment, when the gaming system receives an indication from the player that the player wishes to terminate the gaming session (such as when the gaming system receives a cash out indication) and the supplemental pool has a value that is greater than zero, the player forfeits the supplemental pool. In another such embodiment, when the gaming system receives an indication from the player that the player wishes to terminate the gaming session and the supplemental pool has a value that is greater than zero, the gaming system provides the player with a portion of the supplemental pool. In another such embodiment, when the gaming system receives an indication from the player that the player wishes to terminate the gaming session and the supplemental pool has a value that is greater than zero, the gaming system stores the value of the supplemental pool and initially employs that value for the supplemental pool in next gaming session, regardless of which player initiates the next gaming session initiated on the gaming system.

In other such embodiments, when the gaming system receives an indication from the player that the player wishes to terminate the gaming session and the supplemental pool has a value that is greater than zero, the gaming system provides the player a play of a bonus game that enables the player to win all or part of the supplemental pool. In one example, the bonus game is the card game, and the player must achieve a designated outcome (such as a winning outcome) to win the supplemental pool. In another example, the bonus game is the game of Casino War in which the dealer wins ties (or color-matched ties). In a further example, the bonus game includes a spin of a wheel or a spin of a reel. In one example, the bonus game is a selection game. It should be appreciated that the bonus game may be any suitable game. It should also be appreciated that the probability of the player winning the supplemental pool via the play of the bonus game may be any suitable probability, such as: (a) less than 50%, (b) 50%, (c) greater than 50%, or (d) substantially the same as the probability of the supplemental pool payout condition being met for a given play of the card game.

It should be appreciated that the supplemental pool of the present disclosure is distinct from any progressive awards (such as any of those explained below) available through play of the gaming system. In various embodiments, the gaming system enables the player to win the supplemental pool in addition to winning any available progressive awards.

While the card game is a Blackjack game and a Psi Gow Poker game in the example embodiments described below, it should be appreciated that the card game may be any suitable card or tile game, such as Draw Poker, Pal Gow Tiles, Seven Card Stud, Five Card Stud, Caribbean Poker, Let it Ride, Three Card Poker, and Casino War.

While the embodiments described above (and the example Blackjack and Pai Gow Poker embodiments described below) are directed to a single player card game, the present disclosure contemplates providing the card game as a multiplayer, group, or community card game played by a plurality of players. In certain embodiments, the gaming system maintains a single supplemental pool for the plurality of players of the card game. In these embodiments, whenever an outcome of one of the player's plays of the card game is the designated outcome, the gaming system funds the supplemental pool with at east a portion of that player's wager. Thus, in these embodiments, all players contribute to the single supplemental pool and compete to win that single supplemental pool. If the gaming system determines that a plurality of the players win the supplemental pool at once, the gaming system splits the supplemental pool among those winning players.

In one multiplayer embodiment, the players compete against one another, and not the dealer, to win the single supplemental pool. In one such example, the gaming system does not employ the side bet reset condition. Instead, in this example, the gaming system resets the supplemental pool to an initial value when the supplemental pool payout condition is met. In one instance, the gaming system does not fund the supplemental pool with an amount equal to any portion of the player's wager used to fund the supplemental pool, while in another instance the gaming system does so (even though the dealer cannot "win" the supplemental pool in this example).

In another multiplayer embodiment, the players compete against the dealer and against one another to win the supplemental pool. Thus, in this embodiment, the gaming system employs the side bet reset condition. In one example of this embodiment, the gaming system funds the supplemental pool with an amount equal to any portion of the player's wager used to fund the supplemental pool.

In another multiplayer embodiment, the gaining system maintains separate supplemental pools for the players. That is, in this embodiment, each player is associated with that player's own, individual supplemental pool. Thus, in this embodiment, each player is separately competing against the dealer to win that player's supplemental pool.

Example Blackjack Embodiment

In various embodiments, the card game is a Blackjack game associated with a plurality of cards. Each of the cards is associated with one of a plurality of different values. In this embodiment, for a play of the Blackjack game, the gaming system receives a wager from a player. The gaming system determines a plurality of player cards from the plurality of cards and displays the player cards face up. The gaming system determines a plurality of dealer cards from the plurality of cards and displays at least one of the dealer cards face up. The gaming system enables the player to form a final player hand including at least the player cards, and determines a count of the final player hand by summing the values of the cards in the final player hand. The gaming system forms a final dealer hand including at least the dealer cards and determines a count of the final dealer hand by summing the values of the cards in the final dealer hand. The gaming system displays the cards of the final dealer hand face up.

If the count of the final player hand is greater than the count of the final dealer hand, the gaming system provides an award to the player (i.e., the player wins the play of the Blackjack game). If the count of the final dealer hand is greater than the count of the final player hand, the gaming system ends the play of the Blackjack game (i.e., the player loses the play of the Blackjack game). If the count of the final player hand is equal to the count of the final dealer hand (i.e., the player and the dealer tie), the gaming system funds a supplemental pool with at least a portion of the received wager. That is, in these embodiments, the designated outcome occurs when the count of the final player hand and the count of the final dealer hand are equal (i.e., when the result of the play of the Blackjack game is a "push").

If a supplemental pool payout condition is met, the gaming system provides the supplemental pool to the player. In certain embodiments, when the supplemental pool payout condition is met, the gaming system resets the supplemental pool to an initial value after providing the supplemental pool to the player. In one such embodiment, the initial value is zero, while in another such embodiment the initial value is any suitable value greater than zero. If a supplemental pool reset condition other than the player winning the supplemental pool is met, the gaming system resets a value of the supplemental pool to an initial value. In certain embodiments, the initial value is zero, while in other embodiments the initial value is any suitable value greater than zero.

FIGS. 2A, 2B, 2C, 2D, 2E, and 2F illustrate screen shots of the gaming system of the present disclosure operating one example of the card game in which the card game is a Blackjack game. In this example, the supplemental pool is a side pot and the Blackjack game is associated with a plurality of standard fifty-two card decks of playing cards, though any suitable cards, quantity of cards, or quantities of decks of cards may be employed. Each numbered card has a value that is equal to its face value; each Jack, Queen, and King has a value of ten; and each Ace has a value of either one or eleven, depending on which value is more beneficial to the player. In this example, as described above, the designated outcome occurs for a play of the Blackjack game when the count of the final player hand and the count of the final dealer hand are equal (i.e., when the result of a play of the Blackjack game is a "push"). Additionally, in this example, the side pot payout condition is met when the player has won five consecutive plays of the Blackjack game, and the side pot reset condition is met when the dealer has won six consecutive plays of the Blackjack game. Further, in this example, when the outcome of a play of the Blackjack game is the designated outcome, the gaming system funds the side pot with an amount equal to the received wager in addition to funding the side pot with the received wager.

In this example, the gaming system displays, such as on a display device 1116 or 1118 (as described below), a dealer's hand display area 220 and a player's hand display 240. The gaming system displays several player inputs or buttons that enable the player to enter decisions and several displays or meters that provide the player information about the player's credits and wagers. In this example, the inputs or buttons include: (a) a wager button 255 that, when selected, causes a wager to be placed for a play of the Blackjack game; and (b) a stand button 251, a hit button 252, a double down button 253, and a split button 254, which become active when appropriate during play of the Blackjack game.

The displays or meters include: a dealer winning streak display 228 that displays a quantity of consecutive plays won by the dealer; a player winning streak display 248 that displays a quantity of consecutive plays won by the player; a dealer hand count display 229 that displays the count of the dealer's hand; a player hand count display 249 that displays the count of the player's hand; a credit meter 272 that displays the player's credit balance; a wager display 274 that displays any wagers placed on a play of the Blackjack game; an award display 276 that displays any awards won for a play of the Blackjack game; a side pot display 278 that displays a current value of the side pot; and a message box 260 that displays messages or indications before, during, or after play of the Blackjack game. While in this illustrated example the gaming system indicates the player's credit balance, the player's wager, and any awards provided to the player in the form of amounts of credits, it should be appreciated that such indications may alternatively or additionally be made in the form of amounts of currency.

Figure 2A:
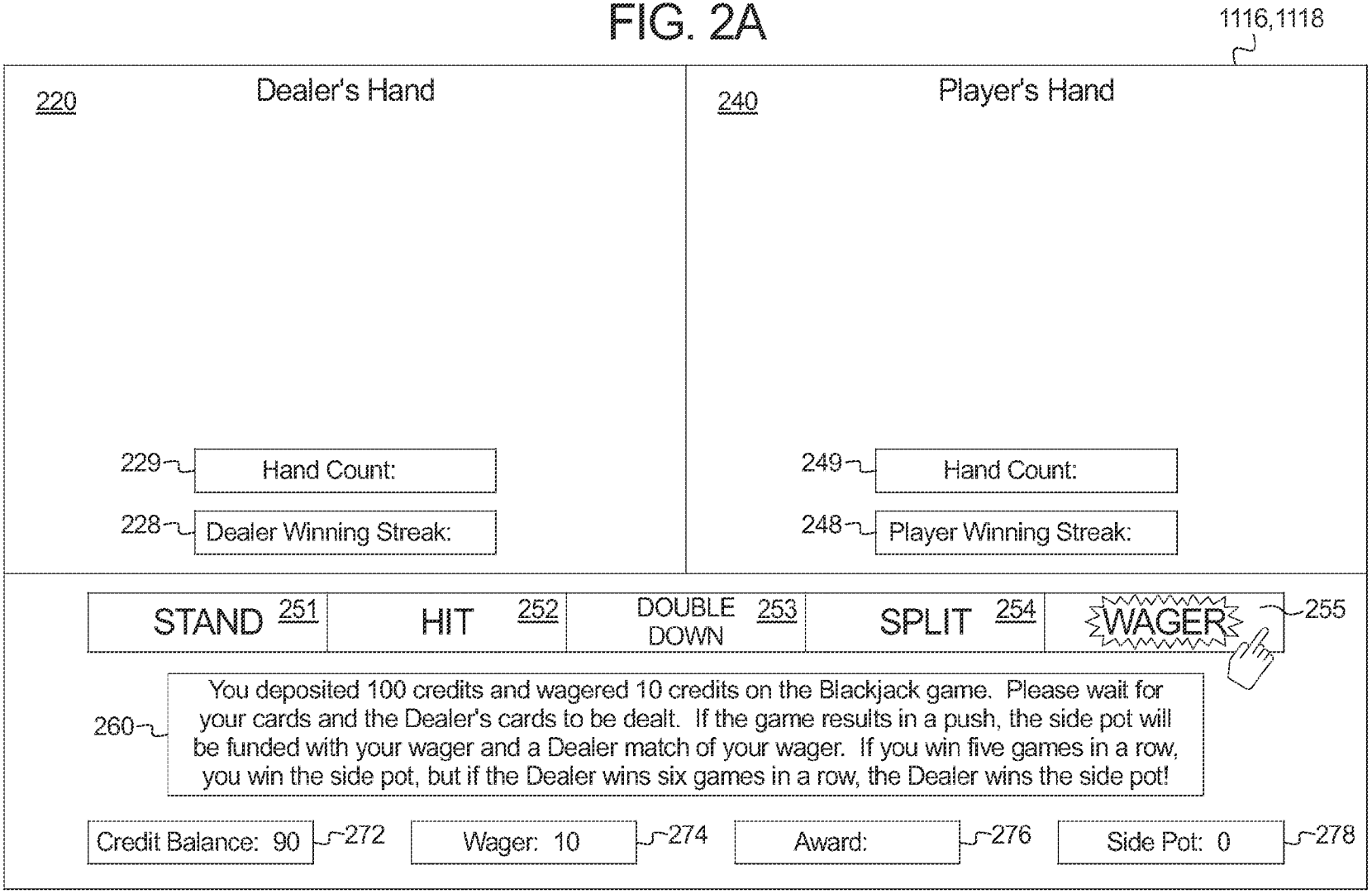
FIGS. 2A, 2B, 2C, 2D, 2E, and 2F illustrate screen shots of the gaming system of the present disclosure operating one example of the card game of the present disclosure in which the card game is a Blackjack game.
Figure 2B:
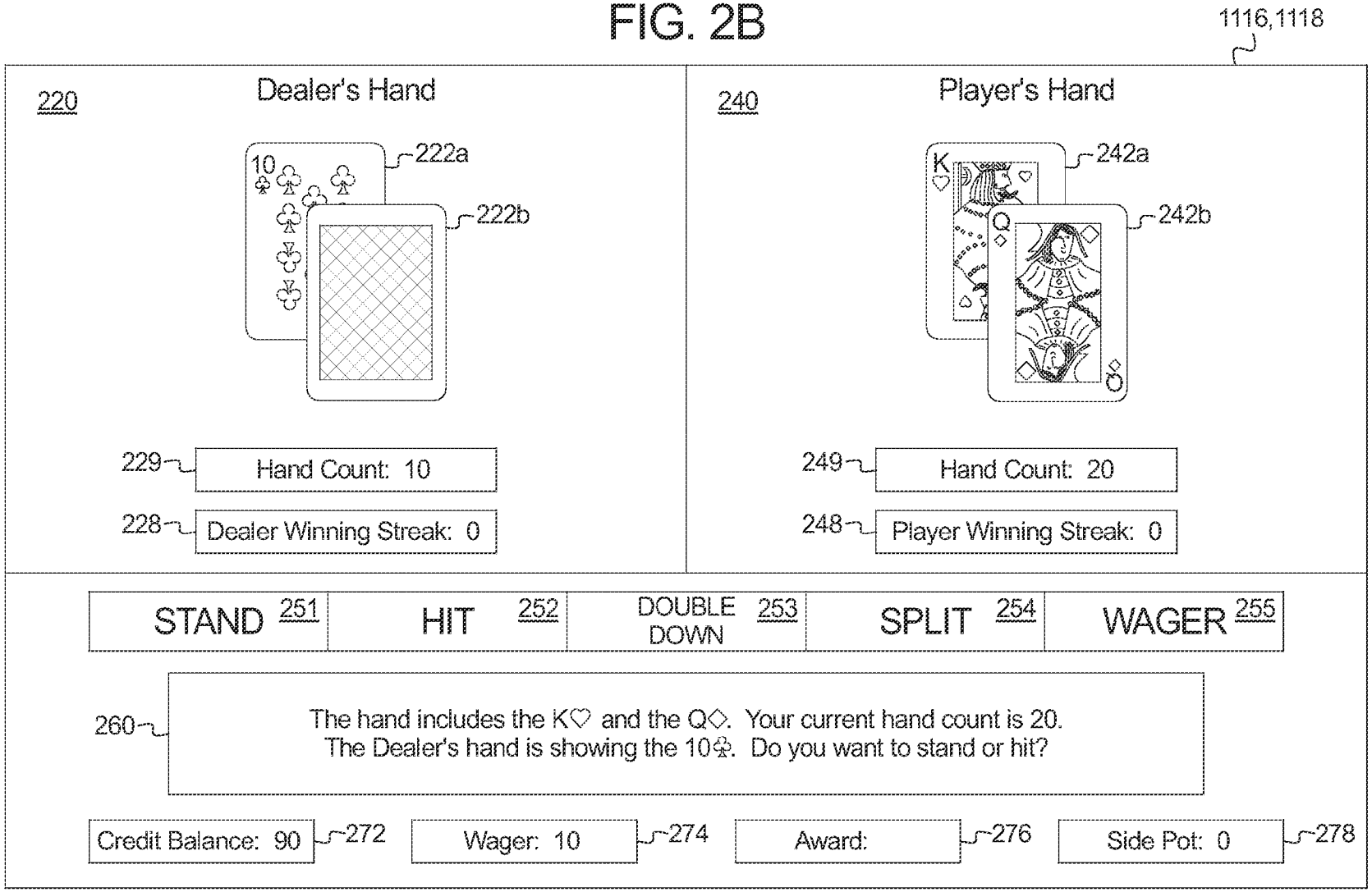
Figure 2C:
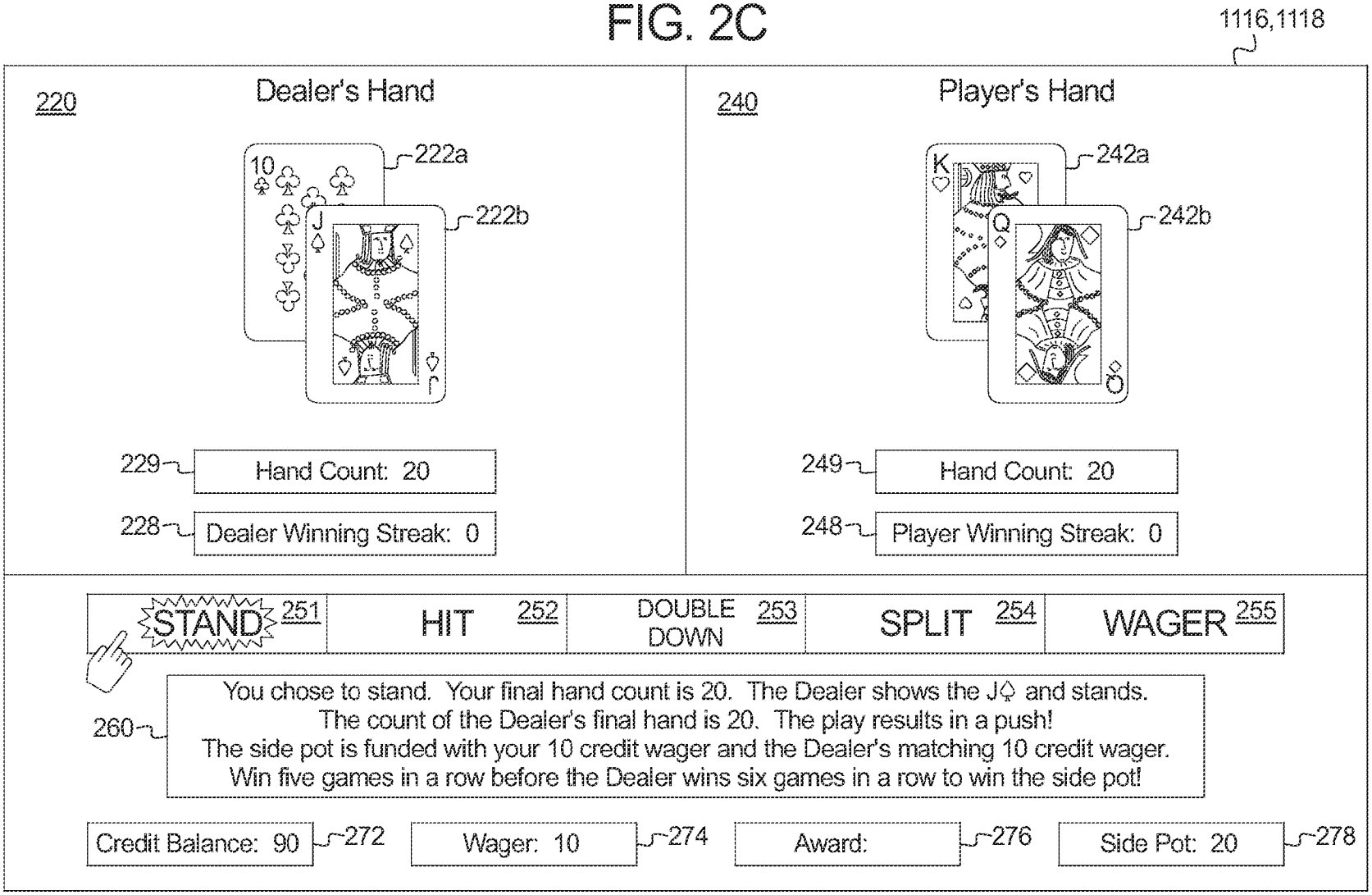

FIGS. 2A, 2B, and 2C illustrate screen shots of a first play of the Blackjack game. As illustrated in FIG. 2A, a player funds the gaming system by depositing value. The gaming system provides the player with 100 credits, which represent the deposited value in this example. The player subsequently places a wager of 10 credits for a play of the Blackjack game. The gaming system displays the player's wager of 10 credits in wager display 274. The gaming system displays the player's total remaining credit balance of 90 credits (i.e., the player's initial credit balance of 100 credits minus the player's wager of 10 credits) in credit meter 272. At this point in time, the side pot includes 0 credits, and the gaming system displays 0 credit value of the side pot in side pot display 278. The gaming system displays the following message in message box 260: "YOU DEPOSITED 100 CREDITS AND WAGERED 10 CREDITS ON THE BLACKJACK GAME. PLEASE WAIT FOR YOUR CARDS AND THE DEALER'S CARDS TO BE DEALT. IF THE GAME RESULTS IN A PUSH, THE SIDE POT WILL BE FUNDED WITH YOUR WAGER AND A DEALER MATCH OF YOUR WAGER. IF YOU WIN FIVE GAMES IN A ROW, YOU WIN THE SIDE POT, BUT IF THE DEALER WINS SIX GAMES IN A ROW, THE DEALER WINS THE SIDE POT!"

As illustrated in FIG. 2B, the gaming system forms an initial player hand by determining two player cards 242*a* and 242*b*, which the gaming system displays face up. Player card 242*a* is the K♥ and player card 242*b* is the Q♦. As shown in player hand count display 249, the count of the player's initial hand is twenty. The gaming system forms an initial dealer hand by determining two dealer cards 222*a*, which is displayed face up; and 222*b*, which is displayed face down. Dealer card 222*a* is the 10♣ . The value of Dealer card 222*a* (i.e., ten) is displayed in dealer hand count display 229. Note that in this case, the dealer's up-card is the 10♣ , which would normally require an immediate resolution as to whether or not the dealer has "Blackjack," as per certain Blackjack rules. In this particular example, however, the gaming system enables the player to "hit" or "stand" for illustrative purposes without making such determination, Because, in this example, the player cards are not a matching pair, the gaming system does not enable the player to "split." Additionally, because in this example the count of the player's hand is not nine, ten, or eleven, the gaming system does not enable the player to "double down." The gaming system displays the following message in message box 260: "YOUR HAND INCLUDES THE K♥ AND THE Q♦. YOUR CURRENT HAND COUNT IS 20. THE DEALER'S HAND IS SHOWING THE 10♣ . DO YOU WANT TO STAND OR HIT?"

As illustrated in FIG. 2C, the gaming system receives an input from the player indicating the player's decision to "stand" and finalize the player's hand. The count of the player's final hand is, therefore, twenty, as displayed in player hand count display 249. The gaming system reveals that dealer card 222*b* is the J♠. Based on the house rules, the dealer "stands" and finalizes the dealer's hand. The count of the dealer's final hand is also twenty, as displayed in dealer hand count display 229. Since the count of the player's final hand and the count of the dealer's final hand are equal, the outcome of the game is a "push" or tie outcome. In this example, this "push" outcome is the designated outcome. Accordingly, the gaming system funds the side pot with the player's wager of 10 credits and with an additional 10 credits (i.e., the Dealer match provided by the "house"). The gaming system does not return any part of the player's wager used to fund the side pot to the player (as is typical is standard Blackjack games when the outcome is a "push"). The gaming system displays the 20 credit value of the side pot in side pot display 278. The gaming system displays the following message in message box 260: "YOU CHOSE TO STAND. YOUR FINAL HAND COUNT IS 20. THE DEALER SHOWS THE J♠ AND STANDS. THE COUNT OF THE DEALER'S FINAL HAND IS 20, THE PLAY RESULTS IN A PUSH! THE SIDE PUT IS FUNDED WITH YOUR 10 CREDIT WAGER AND THE DEALER'S MATCHING 10 CREDIT WAGER. WIN FIVE GAMES IN A ROW BEFORE THE DEALER WINS SIX GAMES IN A ROW TO WIN THE SIDE POT!"

Figure 2D:
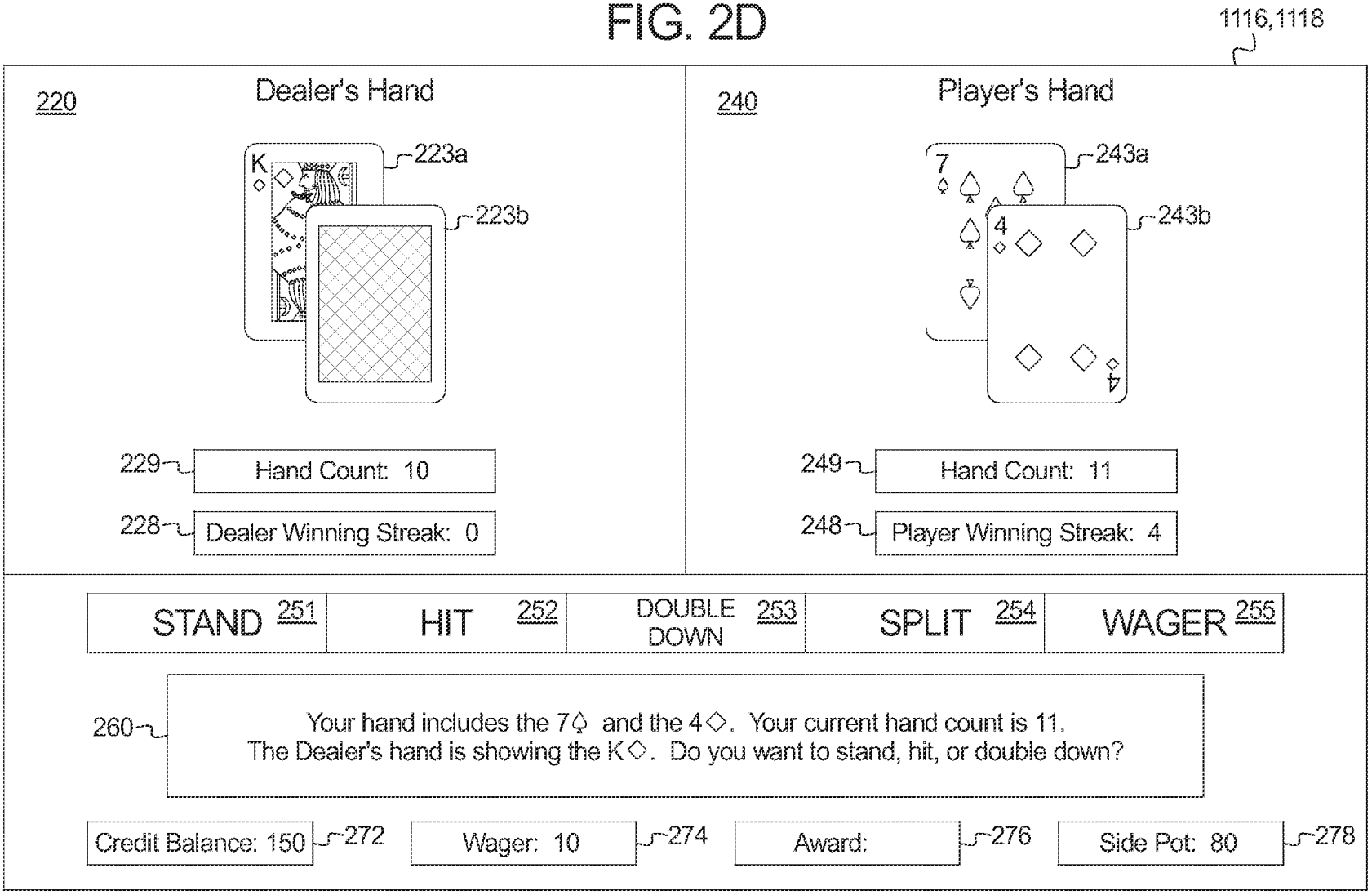
Figure 2E:
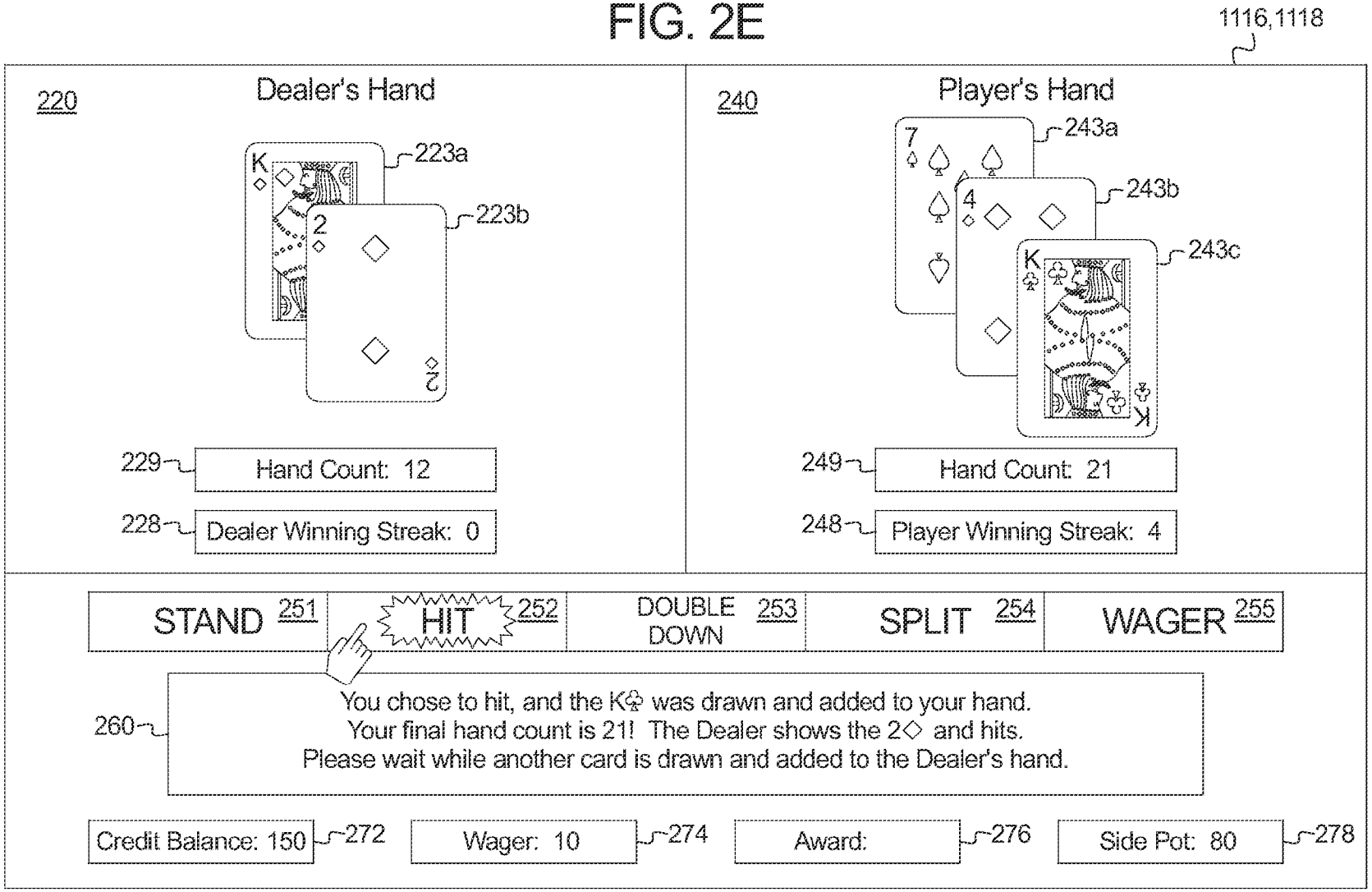
Figure 2F:
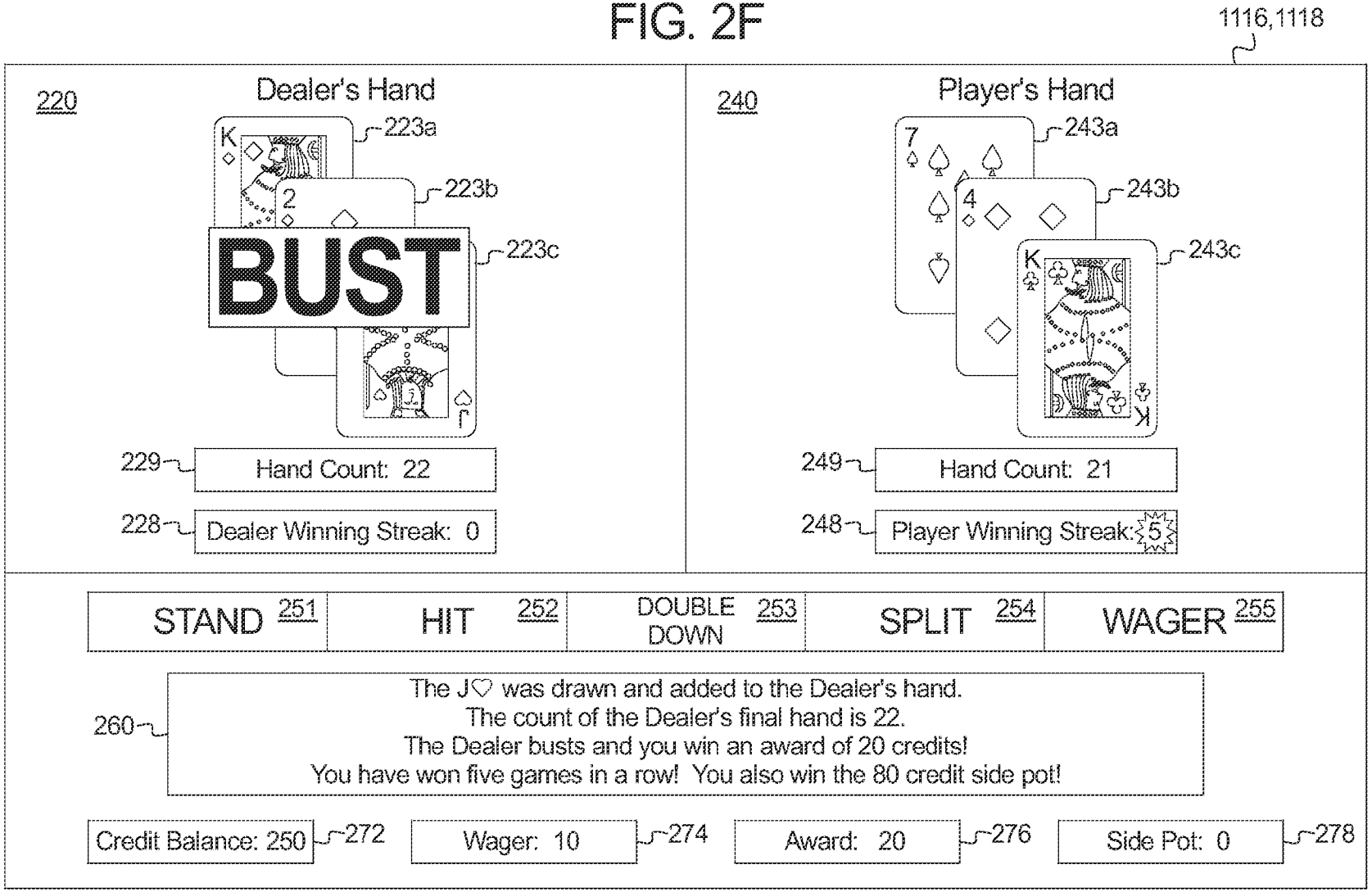

FIGS. 2D, 2E, and 2F illustrate screen shots of a subsequent play of the Blackjack game. It should be appreciated that immediately prior to the initiation of the play of the Blackjack game, the player won four consecutive plays of the Blackjack game, as indicated by player winning streak display 248. At this point, the value of the side pot is 80 credits, as indicated by side pot display 278, and the player's credit balance is 150 credits, as indicated by credit meter 272. Additionally, the player wagers 10 credits on the play of the Blackjack game, as indicated by wager display 274.

As illustrated in FIG. 2D, the gaming system forms an initial player hand by determining two player cards 243*a* and 243*b*, which the gaming system displays face up. Player card 243*a* is the 7♠ and player card 243*b* is the 4♦. As shown in player hand count display 249, the count of the player's initial hand is eleven. The gaming system forms an initial dealer hand by determining two dealer cards 223*a*, which is displayed face up, and 223*b*, which is displayed face down, Dealer card 223*a* is the K♦. The value of Dealer card 223*a* (i.e., ten) is displayed in dealer hand count display 229. Note that in this case, the dealer's up-card is the K♦, which would normally require an immediate resolution as to whether or not the dealer has "Blackjack," as per certain Blackjack rules. In this particular example, however, the gaming system enables the player to "hit," "stand," or "double down" for illustrative purposes. Because, in this example, the player cards are not a matching pair, the gaming system does not enable the player to "split." The gaming system displays the following message in message box 260: "YOUR HAND INCLUDES THE 7 ♠ AND THE 4♦. YOUR CURRENT HAND COUNT IS 11. THE DEALER'S HAND IS SHOWING THE K♦. DO YOU WANT TO STAND, HIT, OR DOUBLE DOWN?"

As illustrated in FIG. 2E, the gaming system receives an input from the player indicating the player's decision to "hit." The gaming system determines an additional card 243*c* from the plurality of cards and adds card 243*c* to the player's hand. The gaming system displays card 243*c*, which is the K♣ , face up. At this point, the count of the player's hand is twenty-one, as indicated by player hand count display 249, and the gaming system finalizes the player's hand. The gaming system reveals that dealer card 223*b* is the 2♦. Based on the house rules, the dealer "hits." The gaming system displays the following message in message box 260: "YOUR CHOSE TO HIT, AND THE K♣ WAS DRAWN AND ADDED TO YOUR HAND. YOUR FINAL HAND COUNT IS 21! THE DEALER SHOWS THE 2♦ AND HITS. PLEASE WAIT WHILE ANOTHER CARD IS DRAWN AND ADDED TO THE DEALER'S HAND."

As illustrated in FIG. 2F, the gaming system determines an additional card 223*c* from the plurality of cards and adds card 223*c* to the dealer's hand. The gaming system displays card 223*c*, which is the J♥, face up. At this point, the count of the dealer's hand is twenty-two, and the dealer busts. Thus, the player wins the play of the Blackjack game, and the gaming system provides the player with an award of 20 credits (i.e., pays out 1:1 based on the player's wager). Since this winning outcome is the player's fifth win in a row, the gaming system determines that the side pot payout event occurred. Accordingly, the gaming system also provides the player with the 80 credit side pot. In this example, the gaming system resets the value of the side pot to an initial value of zero after providing the side pot to the player. Accordingly, the gaming system updates the player's credit balance displayed in credit meter 272 to reflect the player's 20 credit award for winning the play of the Blackjack game and the player's 80 credit award (i.e., the value of the side pot) for winning five consecutive plays of the Blackjack game. The gaming system displays the following message in message box 260: "THE J♥ WAS DRAWN AND ADDED TO THE DEALER'S HAND. THE COUNT OF THE DEALER'S FINAL HAND IS 22. THE DEALER BUSTS AND YOU WIN AN AWARD OF 20 CREDITS! YOU HAVE WON FIVE GAMES IN A ROW! YOU ALSO WIN THE 80 CREDIT SIDE POT!".

Example Pai Gow Poker Embodiment

In various embodiments, the card game is a Pai Gow Poker game associated with a plurality of cards. In this embodiment, for a play of the Pai Gow Poker game, the gaming system receives a wager from a player. The gaming system determines a plurality of player cards from the plurality of cards and displays the player cards face up. The gaming system determines a rank of the player cards and provides the player a supplemental pool if the rank of the player cards is less than or equal to a first designated rank. The gaming system enables the player to form a first player hand and a second player hand from the player cards. The gaming system determines a plurality of dealer cards from the plurality of cards and displays the dealer cards face up. The gaming system forms a first dealer hand and a second dealer hand from the dealer cards. The gaming system determines a rank of the dealer cards and resets a value of the supplemental pool to an initial value if the rank of the dealer cards is less than or equal to a second designated rank.

If a rank of the first player hand is higher than a rank of the first dealer hand and a rank of the second player hand is higher than a rank of the second dealer hand, the gaming system provides an award to the player. If the rank of the first dealer hand is higher than the rank of the first player hand and the rank of the second dealer hand is higher than the rank of the second player hand, the gaming system ends the play of the Pai Gow Poker game. If one of: (i) the rank of the first player hand is higher than the rank of the first dealer hand and the rank of the second dealer hand is higher than the rank of the second player hand, and (ii) the rank of the first dealer hand is higher than the rank of the first player hand and the rank of the second player hand is higher than the rank of the second dealer hand, the gaming system funds the supplemental pool with at least part of the received wager. That is, in these embodiments, the designated outcome occurs when one of the player's hands beats one of the dealer's hands and the other one of the player's hands loses to the other one of the dealer's hands (i.e., when the result of the play of the Pai Gow Poker game is a "push").

FIGS. 3A, 3B, 3C, 3D, 3E, 3F, and 3G illustrate screen shots of the gaming system of the present disclosure operating one example of the card game in which the card game is a Pai Gow Poker game. In this example, the supplemental pool is a side pot and the Pai Gow Poker game is associated with a plurality of cards including a standard fifty-two card deck of playing cards and a Joker. In this example, as described above, the designated outcome occurs for a play of the Pai Cow Poker game when one of the player's hands beats one of the dealer's hands and the other one of the player's hands loses to the other one of the dealer's hands (i.e., when the result of the play of the Pai Cow Poker game is a "push"). Additionally, in this example, the side pot payout condition is met when the player's cards form a King-high Pai Gow or worse (i.e., have a designated rank), and the side pot reset condition is met when the dealer's cards form a King-high Pai Cow or worse (i.e., have that same designated rank). Further, in this example, when the outcome of a play of the Pai Gow Poker game is the designated outcome, the gaming system funds the side pot with an amount equal to the received wager in addition to funding the side pot with the received wager.

In this example, the gaming system displays, such as on a display device 1116 or 1118 (as described below), a dealer's hands display area 320 and a player's hands display area 340. Dealer's hands display area 320 includes a dealer cards display area 322, a five-card dealer hand display area 324, and a two-card dealer hand display area 325. Similarly, player's hands display area 340 includes a player cards display area 342, a five-card player hand display area 344, and a two-card player hand display area 346. In this example, the gaming system displays a wager button 365 that, when selected, causes a wager to be placed for a play of the Pai Gow Poker game.

The gaming system also displays a plurality of displays or meters, including; a credit meter 372 that displays the player's credit balance; a wager display 374 that displays any wagers placed on a play of the Pai Cow Poker game; an award display 376 that displays any awards won for a play of the Pai Gow Poker game; a side pot display 378 that displays a current value of the side pot; and a message box 360 that displays messages or indications before, during, or after play of the Pai Gow Poker game. While in this illustrated example the gaming system indicates the player's credit balance, the player's wager, and any awards provided to the player in the form of amounts of credits, it should be appreciated that such indications may alternatively or additionally be made in the form of amounts of currency.

Figure 3A:
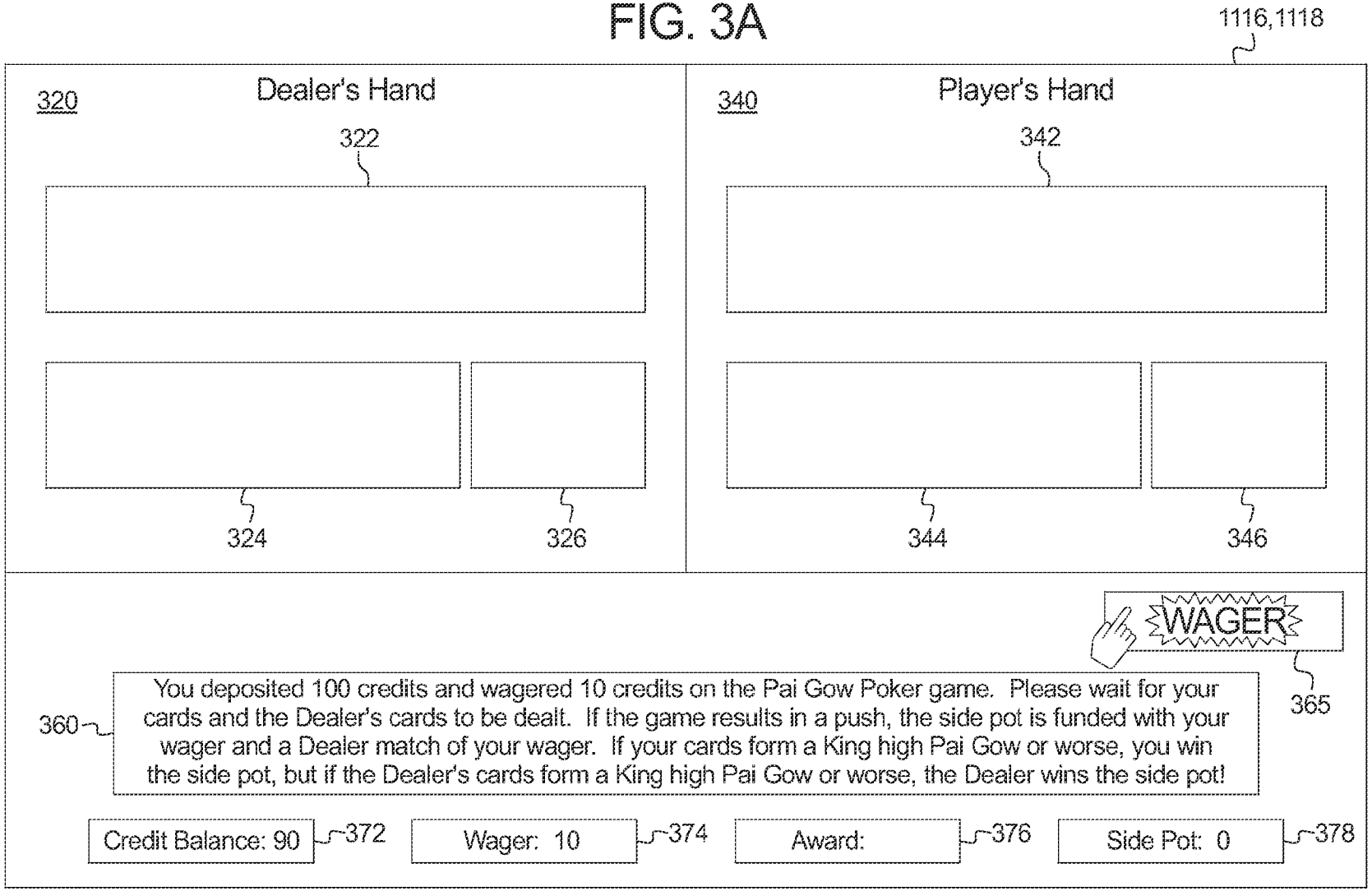
FIGS. 3A, 3B, 3C, 3D, 3E, 3F, and 3G illustrate screen shots of the gaming system of the present disclosure operating another example of the card game of the present disclosure in which the card game is a Pai Gow Poker game.

FIGS. 3A, 3B, 3C, 3D, and 3E illustrate screen shots of a first play of the Pai Gow Poker game. As illustrated in FIG. 3A, a player funds the gaming system by depositing value. The gaming system provides the player with 100 credits, which represent the deposited value in this example. The player subsequently places a wager of 10 credits for a play of the Pai Cow Poker game. The gaming system displays the player's wager of 10 credits in wager display 374. The gaming system displays the player's total remaining credit balance of 90 credits (i.e., the player's initial credit balance of 100 credits minus the player's wager of 10 credits) in credit meter 372. At this point in time, the side pot includes 0 credits, and the gaming system displays 0 credit value of the side pot in side pot display 378. The gaming system displays the following message in message box 360: "YOU DEPOSITED 100 CREDITS AND WAGERED 10 CREDITS ON THE PAI COW POKER GAME. PLEASE WAIT FOR YOUR CARDS AND THE DEALER'S CARDS TO BE DEALT. IF THE GAME RESULTS IN A PUSH, THE SIDE POT IS FUNDED WITH YOUR WAGER AND A DEALER MATCH OF YOUR WAGER. IF YOUR CARDS FORM A KING-HIGH PAI GOW OR WORSE, YOU WIN THE SIDE POT, BUT IF THE DEALER'S CARDS FORM A KING-HIGH PAI GOW OR WORSE, THE DEALER WINS THE SIDE POT!"

Figure 3B:
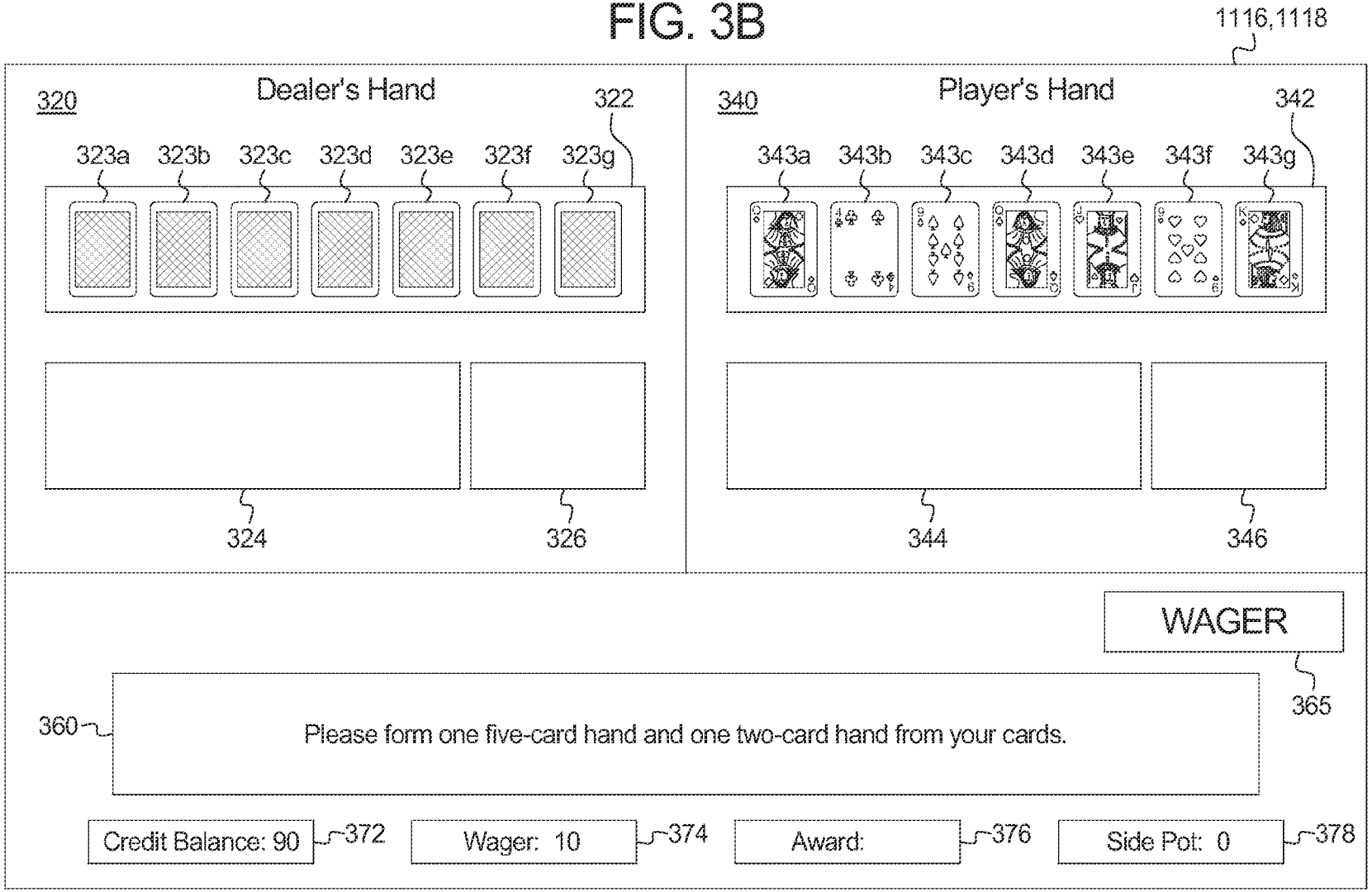

As illustrated in FIG. 3B, the gaming system determines seven player cards 343*a*, 343*b*, 343*c*, 343*d*, 343*e*, 343*f*, and 343*g* from the plurality of cards, which the gaming system displays face up in player cards display area 342. Player card 343*a* is the Q♦, player card 343*b* is the 4♣, player card 343*c* is the 9♠, player card 343*d* is the Q♠, player card 343*e* is the J♥, player card 343*f* is the 9♥, and player card 343*g* is the K. The gaming system determines seven dealer cards 323*a*, 323*b*, 323*c*, 323*d*, 323*e*, 323*f*, and 323*g* from the plurality of cards, which the gaming system displays face down in dealer cards display area 322. In this instance, the player cards do not form a King-high Pai Gow or worse and, therefore, the gaming system determines that the side pot payout condition is not met. The gaming system displays the following message in message box 360: "PLEASE FORM ONE FIVE-CARD HAND AND ONE TWO-CARD HAND FROM YOUR CARDS."

Figure 3C:
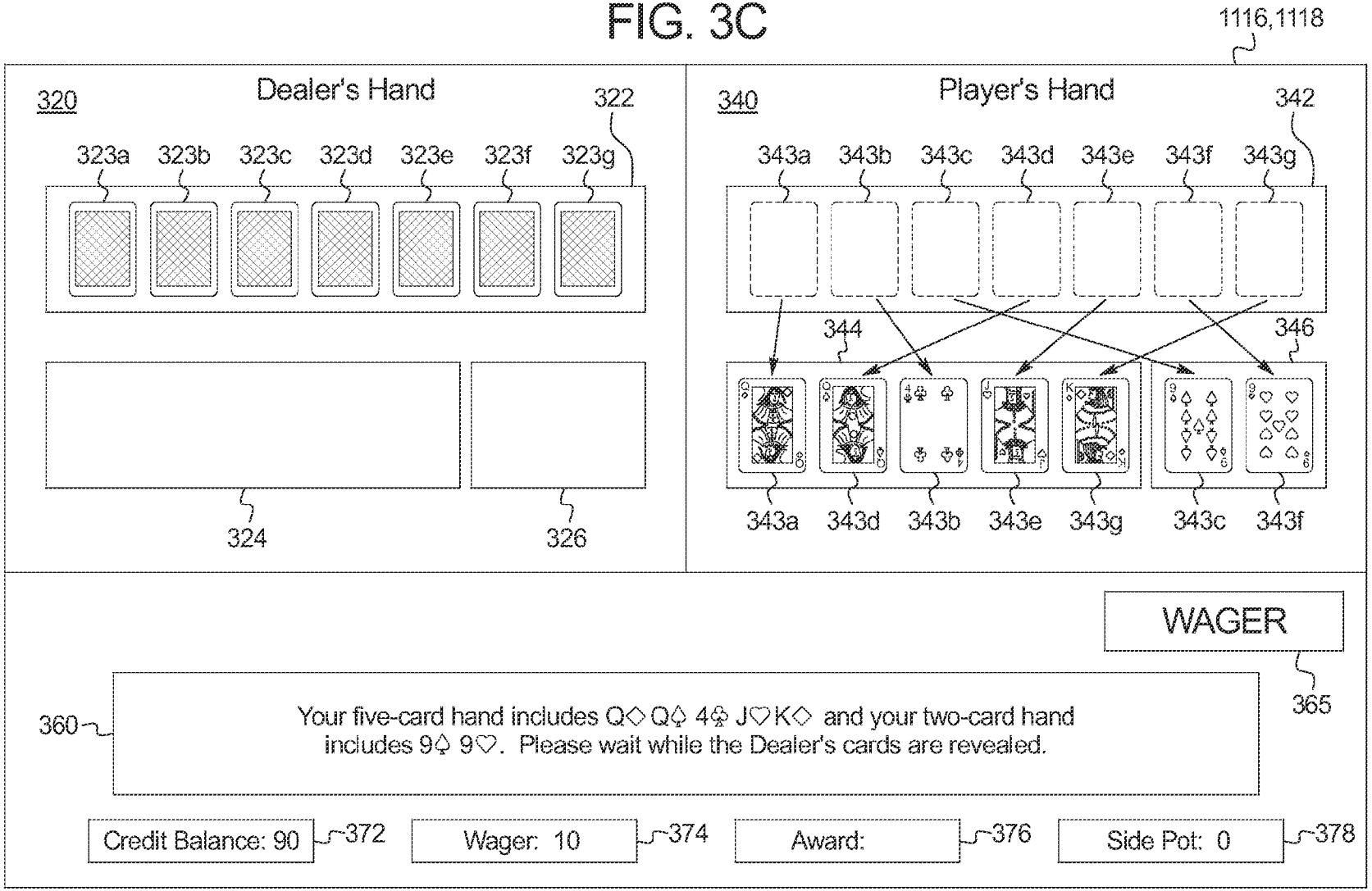

As illustrated in FIG. 3C, the gaming system receives inputs from the player forming the player's five-card hand using player cards 343*a*, 343*b*, 343*d*, 343*e*, and 343*f*, and forming the player's two-card hand using player cards 343*c* and 343*f*. The gaming system displays the player's five-card hand of Q♦ Q♠ 4♣ J♥ K♦ in five-card player hand display area 344 and the player's two-card hand of 9♠ 9♥ In two-card player hand display area 346. The gaming system displays the following message in message box 360: "YOUR FIVE-CARD HAND INCLUDES Q♦ Q♠ 4♣ J♥ K♦ AND YOUR TWO-CARD HAND INCLUDES 9♠ 9♥. PLEASE WAIT WHILE THE DEALER'S CARDS ARE REVEALED."

Figure 3D:
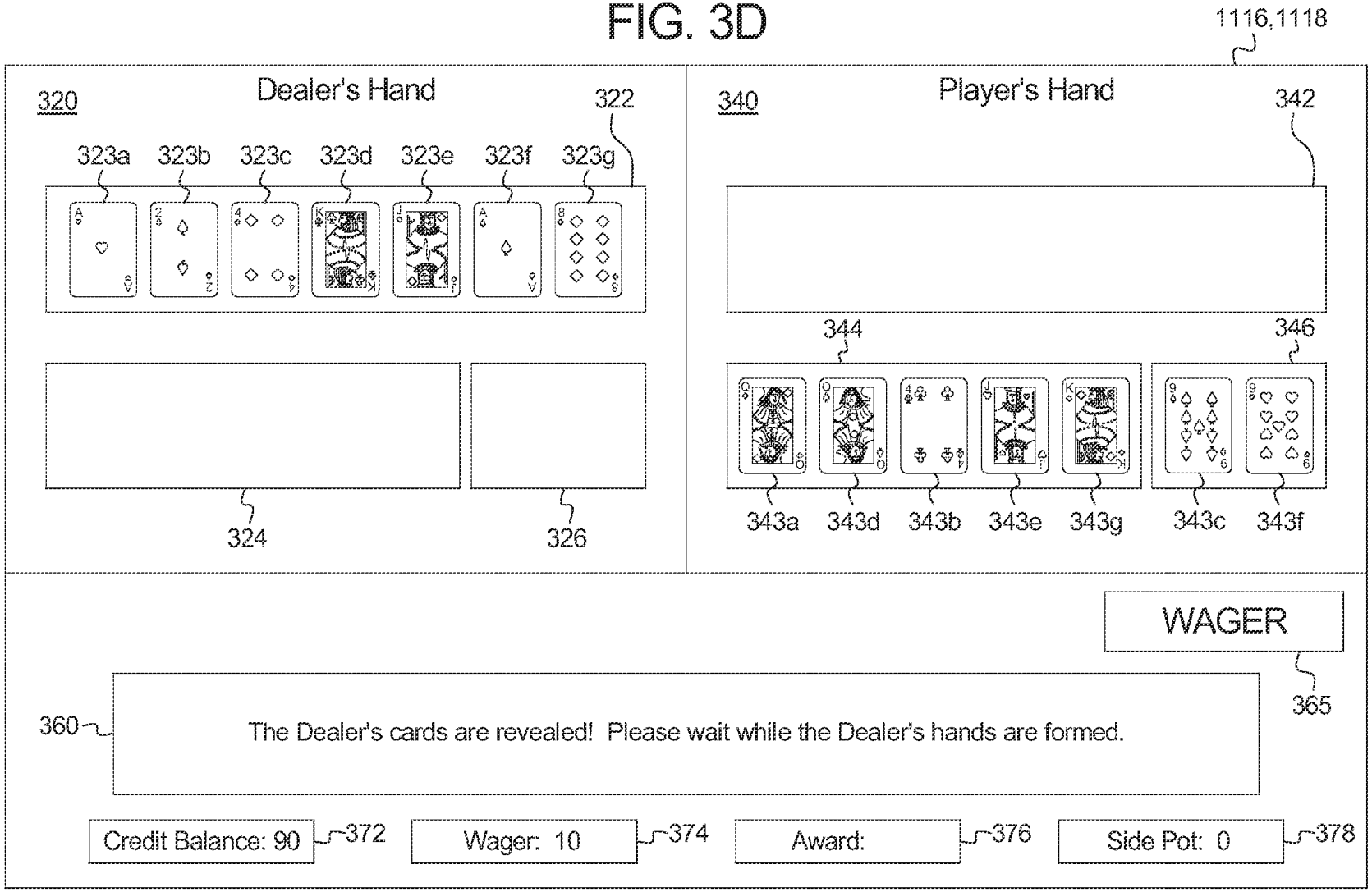

As illustrated in FIG. 3D, the gaming system reveals the dealer cards. In this example, Dealer card 323*a* is the A♥, dealer card 323*b* is the 2♠, dealer card 323*c* is the 4♦, dealer card 323*d* is the K♣, dealer card 323*e* is the J♦, dealer card 323*f* is the A♠, and dealer card 323*g* is the 8♦. In this instance, the dealer cards do not form a King-high Pal Gow or worse and, therefore, the gaming system determines that the side pot reset condition is not met. The gaming system displays the following message in message box 360: "THE DEALER'S CARDS ARE REVEALED! PLEASE WAIT WHILE THE DEALER'S HANDS ARE FORMED."

Figure 3E:
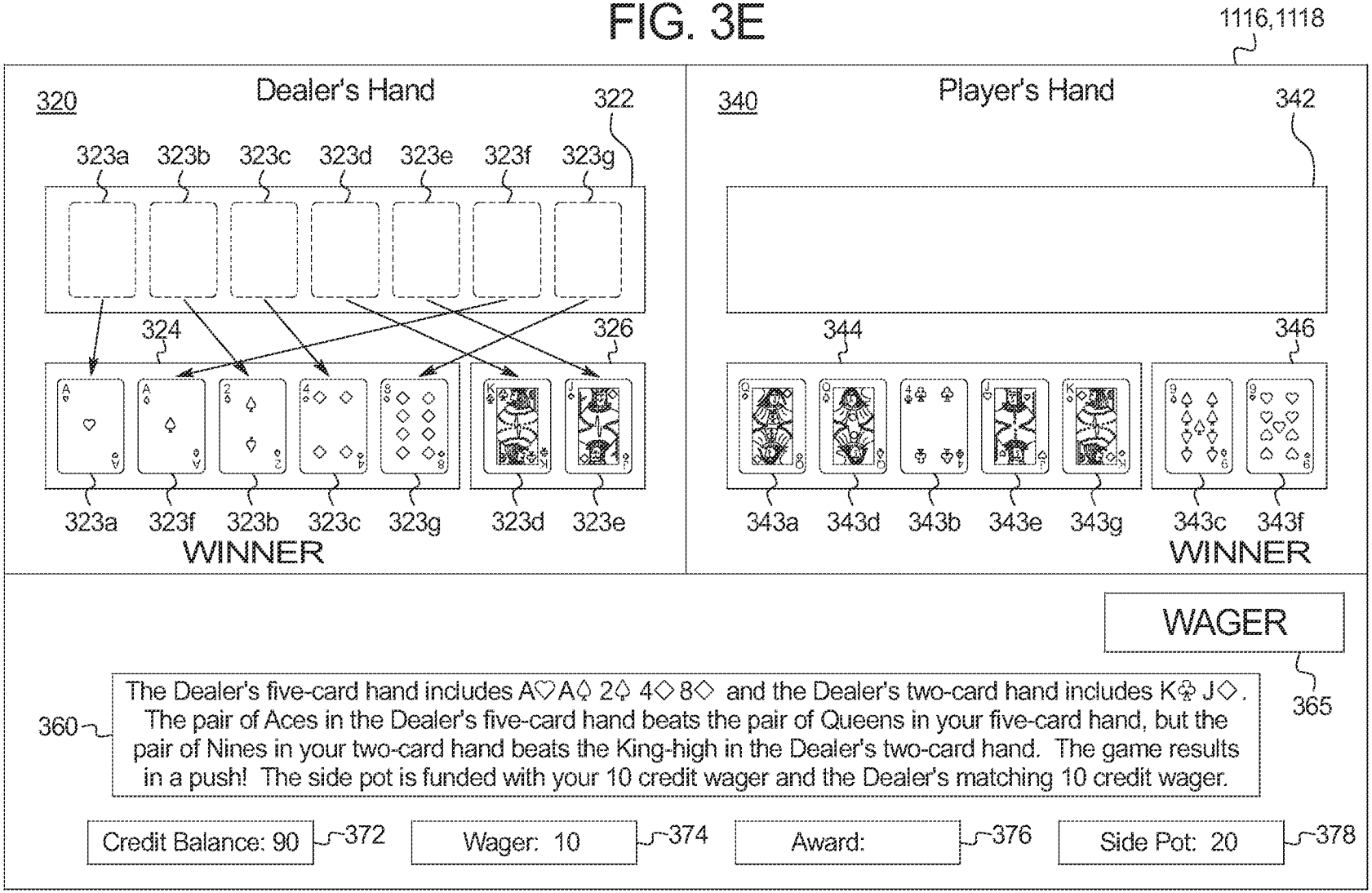

As illustrated in FIG. 3E, the gaming system employs the "House Way" rules to form the five-card dealer hand using dealer cards 323*a*, 323*b*, 323*c*, 323*f*, and 332*g*, and the two-card player hand using dealer cards 323*d* and 323*e*. The gaming system displays the dealer's five-card hand of A♥ A♠ 2♠ 4♦ 8♦ in five-card dealer hand display area 324 and the dealer's two-card hand of K♣ J♦ in two-card dealer hand display area 346. The gaming system determines that the five-card dealer hand has a higher rank (i.e., a pair of Aces) than a rank of the five-card player hand (i.e., a pair of Queens) and, therefore, that the five-card dealer hand beats the five-card player hand. The gaming system determines that the two-card player hand has a higher rank (i.e., a pair of Nines) than a rank of the two-card dealer hand (i.e., a King high).

Accordingly, the gaming system determines that the outcome of the Pai Gow Poker game is a "push" outcome. In this example, this "push" outcome is the designated outcome. Accordingly, the gaming system funds the side pot with the player's wager of 10 credits and with an additional 10 credits (i.e., the Dealer match provided by the "house"). The gaming system does not return any part of the player's wager used to fund the side pot to the player (as is typical is standard Pai Gow Poker games when the outcome is a "push"). The gaming system displays the 20 credit value of the side pot in side pot display 378. The gaming system displays the following message in message box 3260: "THE DEALER'S FIVE-CARD HAND INCLUDES A♥ A♠ 2♠ 4♦ 8♦ AND THE DEALER'S TWO-CARD HAND INCLUDES K♣ J♦. THE PAIR OF ACES IN THE DEALER'S FIVE-CARD HAND BEATS THE PAIR OF QUEENS IN YOUR FIVE-CARD HAND, BUT THE PAIR OF NINES IN YOUR TWO-CARD HAND BEATS THE KING HIGH IN THE DEALER'S TWO-CARD HAND. THE GAME RESULTS IN A PUSH! THE SIDE POT IS FUNDED WITH YOUR 10 CREDIT WAGER AND THE DEALER'S MATCHING 10 CREDIT WAGER."

Figure 3F:
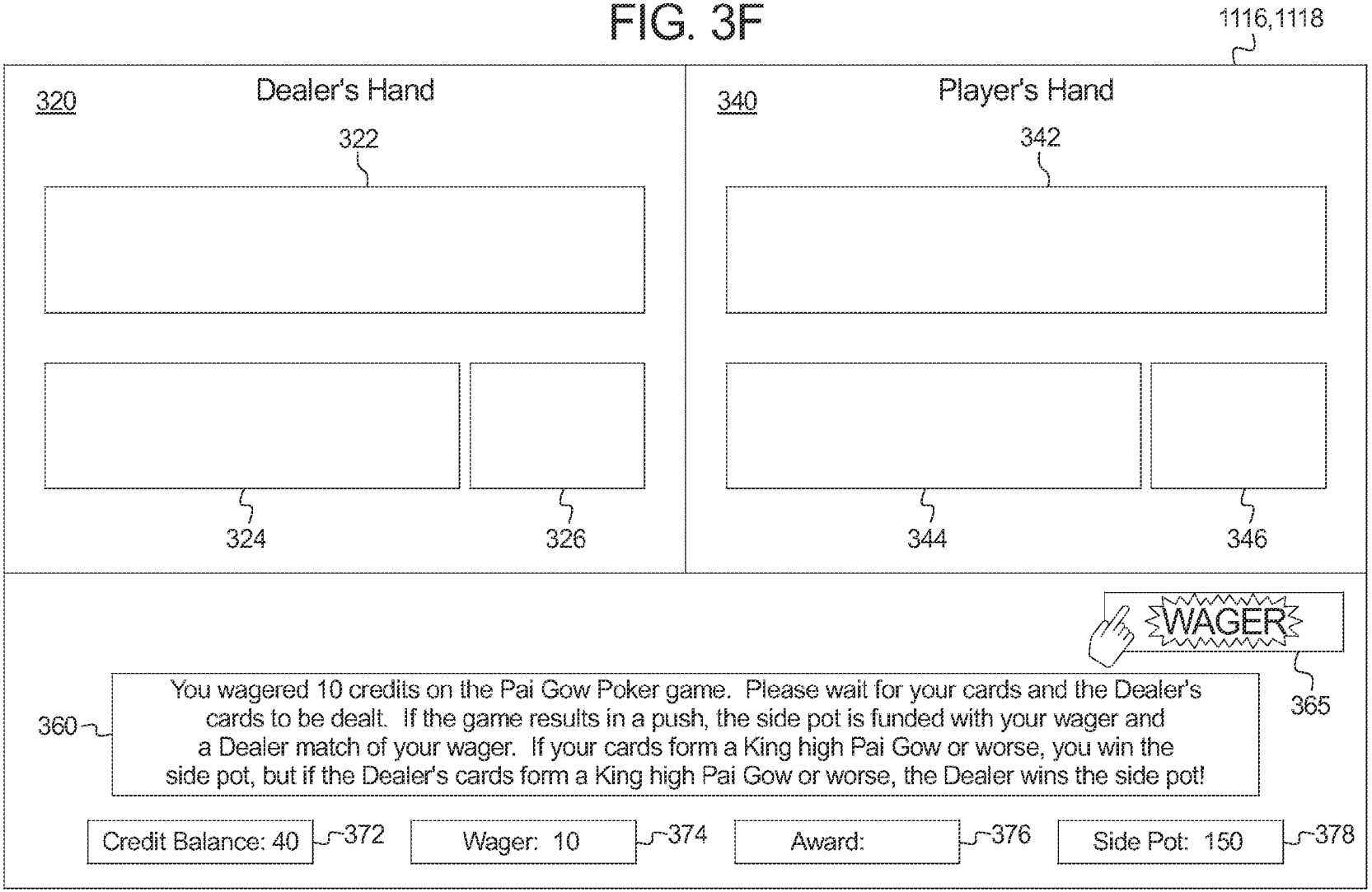
Figure 3G:
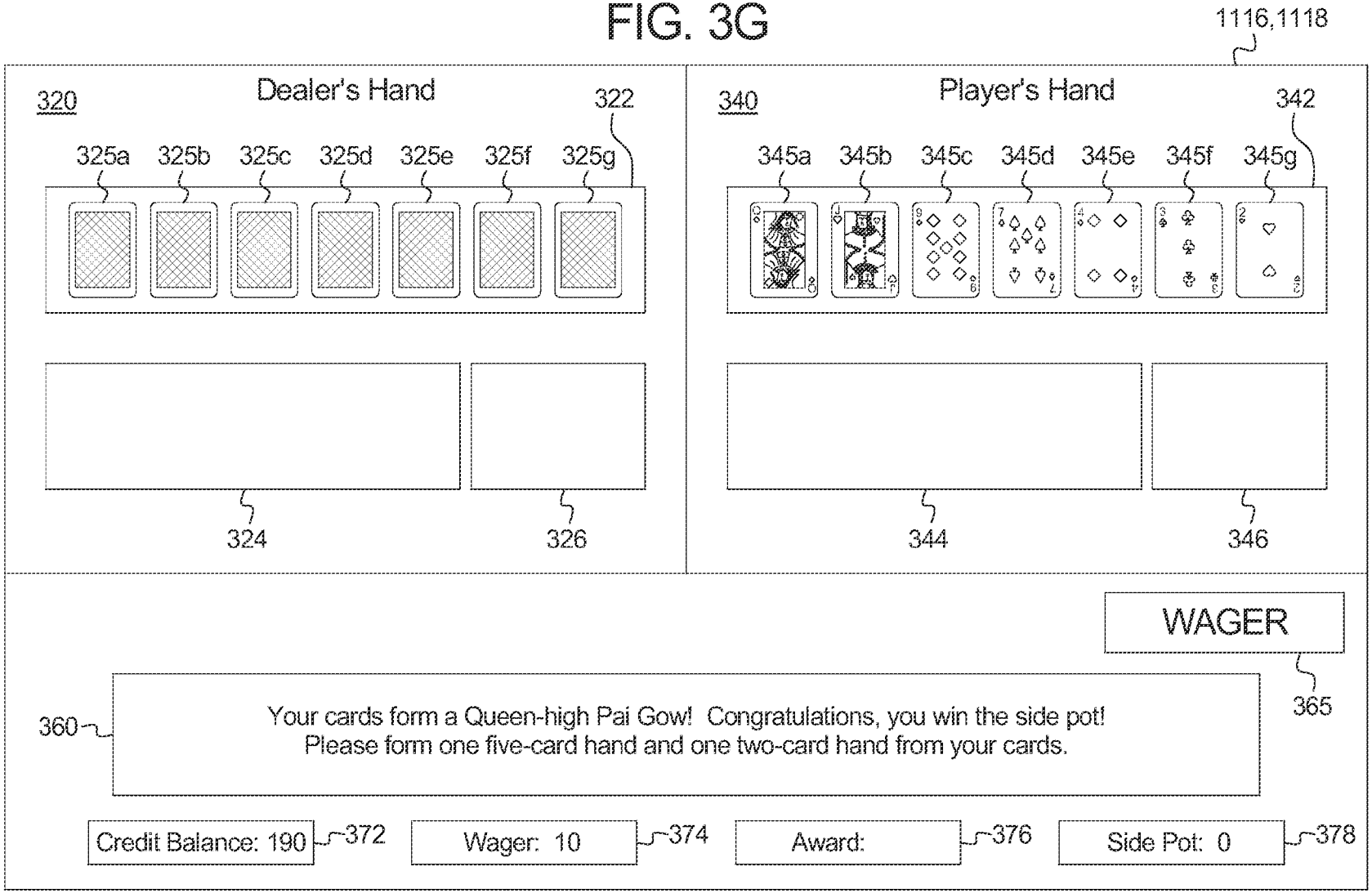

FIGS. 3F and 3G illustrate screen shots of a subsequent play of the Pai Gow Poker game. At this point, the value of the side pot is 150 credits, as indicated by side pot display 378, and the player's credit balance is 40 credits, as indicated by credit meter 372. Additionally, the player wagers 10 credits on the play of the Pai Gow Poker game, as indicated by wager display 374. As shown in FIG. 3F, the gaming system displays the following message in message box 360: "YOU DEPOSITED 100 CREDITS AND WAGERED 10 CREDITS ON THE PAI GOW POKER GAME. PLEASE WAIT FOR YOUR CARDS AND THE DEALER'S CARDS TO BE DEALT. IF THE GAME RESULTS IN A PUSH, THE SIDE POT IS FUNDED WITH YOUR WAGER AND A DEALER MATCH OF YOUR WAGER. IF YOUR CARDS FORM A KING-HIGH PAI GOW OR WORSE, YOU WIN THE SIDE POT, BUT IF THE DEALER'S CARDS FORM A KING-HIGH PAI GOW OR WORSE, THE DEALER WINS THE SIDE POT!"

As illustrated in FIG. 3G, the gaming system determines seven player cards 345*a*, 345*b*, 345*c*, 345*d*, 345*e*, 345*f*, and 345*g* from the plurality of cards, which the gaming system displays face up in player cards display area 342. Player card 345*a* is the Q♦, player card 345*b* is the J♥, player card 345*c* is the 9♦, player card 345*d* is the 7♠, player card 345*e* is the 4♦, player card 345*f* is the 3♣, and player card 345*g* is the 2♥. The gaming system determines seven dealer cards 325*a*, 325*b*, 325*c*, 325*d*, 325*e*, 325*f*, and 325*g* from the plurality of cards, which the gaming system displays face down in dealer cards display area 322. In this instance, the player cards form a King-high Pai Gow or worse and, specifically, form a Queen-high Pai Gow. Thus, the gaming system determines that the side pot payout condition is met, and provides the player the side pot. The gaming system then enables the player to continue the play of the Pai Gow Poker game (not shown). The gaming system displays the following message in message box 360; "YOUR CARDS FORM A QUEEN-HIGH PAI GOW! CONGRATULATIONS, YOU WIN THE SIDE POT! PLEASE FORM ONE FIVE-CARD HAND AND ONE TWO-CARD HAND FROM YOUR CARDS."

Gaming Systems

It should be appreciated that the above-described embodiments of the present disclosure may be implemented in accordance with or in conjunction with one or more of a variety of different types of gaming systems, such as, but not limited to, those described below.

The present disclosure contemplates a variety of different gaming systems each having one or more of a plurality of different features, attributes, or characteristics. It should be appreciated that a "gaming system" as used herein refers to various configurations of: (a) one or more central servers, central controllers, or remote hosts; (b) one or more EGMs; and/or (c) one or more personal gaming devices, such as desktop computers, laptop computers, tablet computers or computing devices, personal digital assistants (PDAs), mobile telephones such as smart phones, and other mobile computing devices.

Thus, in various embodiments, the gaming system of the present disclosure includes: (a) one or more EGMs in combination with one or more central servers, central controllers, or remote hosts: (b) one or more personal gaming devices in combination with one or more central servers, central controllers, or remote hosts; (c) one or more personal gaming devices in combination with one or more EGMs; (d) one or more personal gaming devices, one or more EGMs, and one or more central servers, central controllers, or remote hosts in combination with one another; (e) a single EGM; (f) a plurality of EGMs in combination with one another; (g) a single personal gaming device; (h) a plurality of personal gaming devices in combination with one another; (i) a single central server, central controller, or remote host; and/or (j) a plurality of central servers, central controllers, or remote hosts in combination with one another.

For brevity and clarity, each EGM and each personal gaming device of the present disclosure is collectively referred to herein as an "EGM." Additionally, for brevity and clarity, unless specifically stated otherwise, "EGM" as used herein represents one EGM or a plurality of EGMs, and "central server, central controller, or remote host" as used herein represents one central server, central controller, or remote host or a plurality of central servers, central controllers, or remote hosts.

Figure 4A:
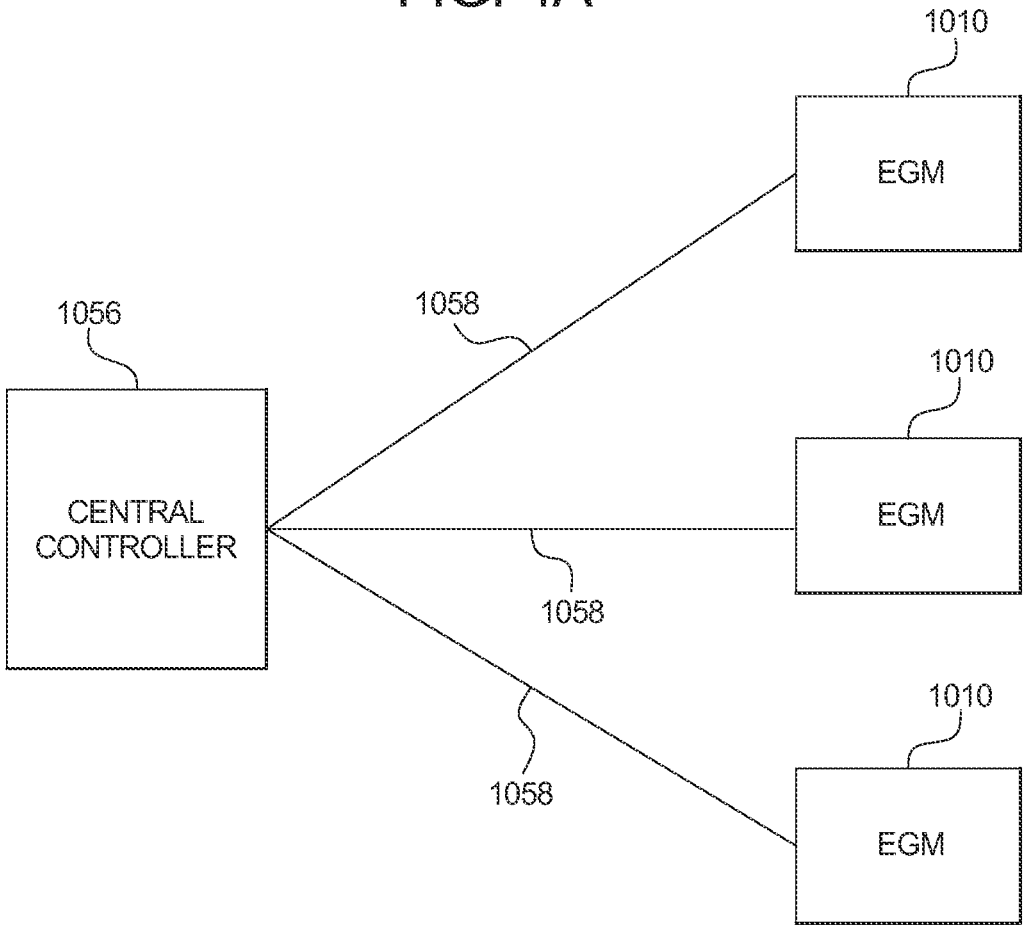
FIG. 4A is a schematic block diagram of one embodiment of a network configuration of the gaming system of the present disclosure.

As noted above, in various embodiments, the gaming system includes an EGM in combination with a central server, central controller, or remote host. In such embodiments, the EGM is configured to communicate with the central server, central controller, or remote host through a data network or remote communication link. In certain such embodiments, the EGM is configured to communicate with another EGM through the same data network or remote communication link or through a different data network or remote communication link. For example, the gaming system illustrated in FIG. 4A includes a plurality of EGMs 1010 that are each configured to communicate with a central server, central controller, or remote host 1056 through a data network 1058.

In certain embodiments in which the gaming system includes an EGM in combination with a central server, central controller, or remote host, the central server, central controller, or remote host is any suitable computing device (such as a server) that includes at least one processor and at least one memory device or storage device. As further described below, the EGM includes at least one EGM processor configured to transmit and receive data or signals representing events, messages, commands, or any other suitable information between the EGM and the central server, central controller, or remote host. The at least one processor of that EGM is configured to execute the events, messages, or commands represented by such data or signals in conjunction with the operation of the EGM. Moreover, the at least one processor of the central server, central controller, or remote host is configured to transmit and receive data or signals representing events, messages, commands, or any other suitable information between the central server, central controller, or remote host and the EGM. The at least one processor of the central server, central controller, or remote host is configured to execute the events, messages, or commands represented by such data or signals in conjunction with the operation of the central server, central controller, or remote host. It should be appreciated that one, more, or each of the functions of the central server, central controller, or remote host may be performed by the at least one processor of the EGM. It should be further appreciated that one, more, or each of the functions of the at least one processor of the EGM may be performed by the at least one processor of the central server, central controller, or remote host.

In certain such embodiments, computerized instructions for controlling any games (such as any primary or base games and/or any secondary or bonus games) displayed by the EGM are executed by the central server, central controller, or remote host. In such "thin client" embodiments, the central server, central controller, or remote host remotely controls any games (or other suitable interfaces) displayed by the EGM, and the EGM is utilized to display such games (or suitable interfaces) and to receive one or more inputs or commands. In other such embodiments, computerized instructions for controlling any games displayed by the EGM are communicated from the central server, central controller, or remote host to the EGM and are stored in at least one memory device of the EGM. In such "thick client" embodiments, the at least one processor of the EGM executes the computerized instructions to control any games (or other suitable interfaces) displayed by the EGM.

In various embodiments in which the gaming system includes a plurality of EGMs, one or more of the EGMs are thin client EGMs and one or more of the EGMs are thick client EGMs. In other embodiments in which the gaming system includes one or more EGMs, certain functions of one or more of the EGMs are implemented in a thin client environment, and certain other functions of one or more of the EGMs are implemented in a thick client environment. In one such embodiment in which the gaming system includes an EGM and a central server, central controller, or remote host, computerized instructions for controlling any primary or base games displayed by the EGM are communicated from the central server, central controller, or remote host to the EGM in a thick client configuration, and computerized instructions for controlling any secondary or bonus games or other functions displayed by the EGM are executed by the central server, central controller, or remote host in a thin client configuration.

In certain embodiments in which the gaming system includes: (a) an EGM configured to communicate with a central server, central controller, or remote host through a data network; and/or (b) a plurality of EGMs configured to communicate with one another through a data network, the data network is a local area network (LAN) in which the EGMs are located substantially proximate to one another and/or the central server, central controller, or remote host. In one example, the EGMs and the central server, central controller, or remote host are located in a gaming establishment or a portion of a gaming establishment.

In other embodiments in which the gaming system includes: (a) an EGM configured to communicate with a central server, central controller, or remote host through a data network; and/or (b) a plurality of EGMs configured to communicate with one another through a data network, the data network is a wide area network (WAN) in which one or more of the EGMs are not necessarily located substantially proximate to another one of the EGMs and/or the central server, central controller, or remote host. For example, one or more of the EGMs are located: (a) in an area of a gaming establishment different from an area of the gaming establishment in which the central server; central controller, or remote host is located; or (b) in a gaming establishment different from the gaming establishment in which the central server, central controller, or remote host is located. In another example, the central server, central controller, or remote host is not located within a gaming establishment in which the EGMs are located. It should be appreciated that in certain embodiments in which the data network is a WAN, the gaming system includes a central server, central controller, or remote host and an EGM each located in a different gaming establishment in a same geographic area, such as a same city or a same state. It should be appreciated that gaming systems in which the data network is a WAN are substantially identical to gaming systems in which the data network is a LAN, though the quantity of EGMs in such gaming systems may vary relative to one another.

In further embodiments in which the gaming system includes: (a) an EGM configured to communicate with a central server, central controller, or remote host through a data network; and/or (b) a plurality of EGMs configured to communicate with one another through a data network, the data network is an internet or an intranet. In certain such embodiments, an internet browser of the EGM is usable to access an internet game page from any location where an internet connection is available. In one such embodiment, after the Internet game page is accessed, the central server, central controller, or remote host identifies a player prior to enabling that player to place any wagers on any plays of any wagering games. In one example, the central server, central controller, or remote host identifies the player by requiring a player account of the player to be logged into via an input of a unique username and password combination assigned to the player. It should be appreciated, however, that the central server, central controller, or remote host may identify the player in any other suitable manner, such as by validating a player tracking identification number associated with the player; by reading a player tracking card or other smart card inserted into a card reader (as described below); by validating a unique player identification number associated with the player by the central server, central controller, or remote host; or by identifying the EGM, such as by identifying the MAC address or the IP address of the internet facilitator. In various embodiments, once the central server, central controller, or remote host identifies the player, the central server, central controller, or remote host enables placement of one or more wagers on one or more plays of one or more primary or base games and/or one or more secondary or bonus games, and displays those plays via the internet browser of the EGM.

It should be appreciated that the central server, central controller, or remote host and the EGM are configured to connect to the data network or remote communications link in any suitable manner. In various embodiments, such a connection is accomplished via: a conventional phone line or other data transmission line, a digital subscriber line (DSL), a T-1 line, a coaxial cable, a fiber optic cable, a wireless or wired routing device, a mobile communications network connection (such as a cellular network or mobile internet network), or any other suitable medium. It should be appreciated that the expansion in the quantity of computing devices and the quantity and speed of Internet connections in recent years increases opportunities for players to use a variety of EGMs to play games from an ever-increasing quantity of remote sites. It should also be appreciated that the enhanced bandwidth of digital wireless communications may render such technology suitable for some or all communications, particularly if such communications are encrypted. Higher data transmission speeds may be useful for enhancing the sophistication and response of the display and interaction with players.

EGM Components

Figure 4B:
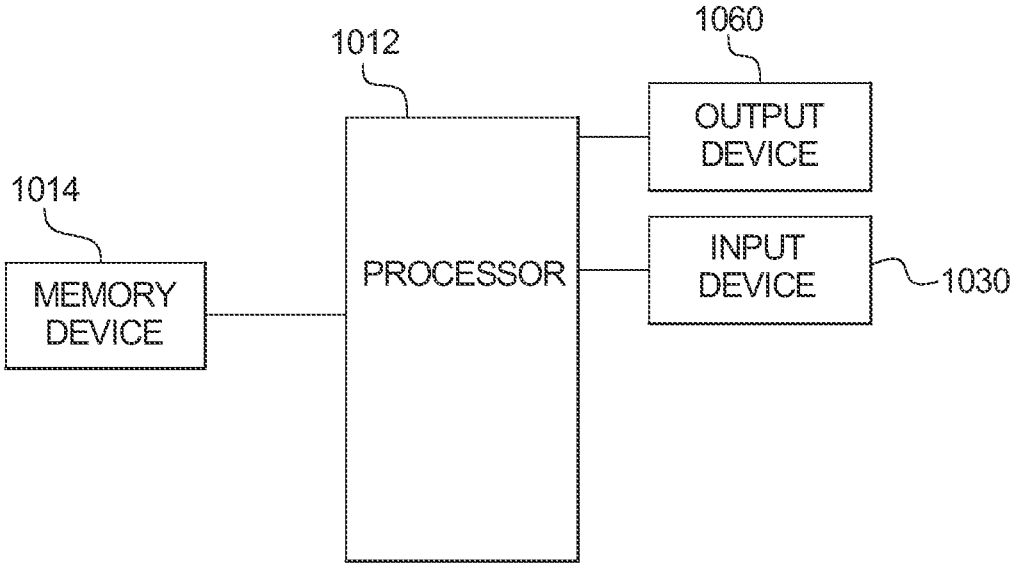
FIG. 4B is a schematic block diagram of an example electronic configuration of the gaming system of the present disclosure.

In various embodiments, an EGM Includes at least one processor configured to operate with at least one memory device, at least one input device, and at least one output device. The at least one processor may be any suitable processing device or set of processing devices, such as a microprocessor, a microcontroller-based platform, a suitable integrated circuit, or one or more application-specific integrated circuits (ASICs). FIG. 4B illustrates an example EGM including a processor 1012.

As generally noted above, the at least one processor of the EGM is configured to communicate with, configured to access, and configured to exchange signals with at least one memory device or data storage device. In various embodiments, the at least one memory device of the EGM Includes random access memory (RAM), which can include non-volatile RAM (NVRAM), magnetic RAM (MRAM), ferroelectric RAM (FeRAM), and other forms as commonly understood in the gaming industry. In other embodiments, the at least one memory device includes read only memory (ROM). In certain embodiments, the at least one memory device of the EGM includes flash memory and/or EEPROM (electrically erasable programmable read only memory). The example EGM illustrated in FIG. 4B includes a memory device 1014, It should be appreciated that any other suitable magnetic, optical, and/or semiconductor memory may operate in conjunction with the EGM disclosed herein. In certain embodiments, the at least one processor of the EGM and the at least one memory device of the EGM both reside within a cabinet of the EGM (as described below). In other embodiments, at least one of the at least one processor of the EGM and the at least one memory device of the EGM reside outside the cabinet of the EGM (as described below).

In certain embodiments, as generally described above, the at least one memory device of the EGM stores program code and instructions executable by the at least one processor of the EGM to control the EGM. The at least one memory device of the EGM also stores other operating data, such as image data, event data, input data, random number generators (RNGs) or pseudo-RNGs, paytable data or information, and/or applicable game rules that relate to the play of one or more games on the EGM (such as primary or base games and/or secondary or bonus games as described below). In various embodiments, part or all of the program code and/or the operating data described above is stored in at least one detachable or removable memory device including, but not limited to, a cartridge, a disk, a CD ROM, a DVD, a USB memory device, or any other suitable non-transitory computer readable medium. In certain such embodiments, an operator (such as a gaming establishment operator) and/or a player uses such a removable memory device in an EGM to implement at least part of the present disclosure. In other embodiments, part or all of the program code and/or the operating data is downloaded to the at least one memory device of the EGM through any suitable data network described above (such as an internet or intranet).

Figure 5A:
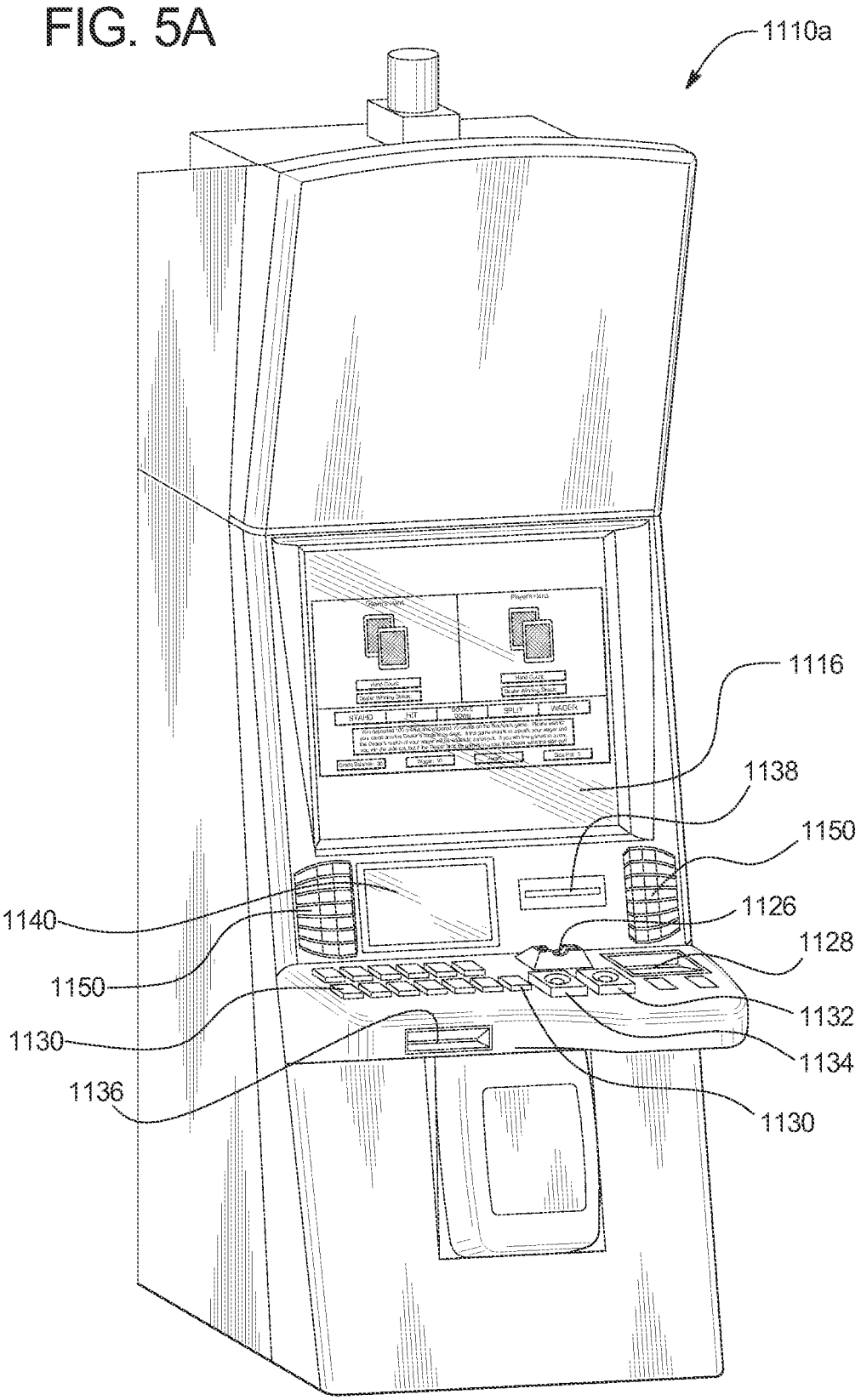
FIGS. 5A and 5B are perspective views of example alternative embodiments of the gaming system of the present disclosure.
Figure 5B:
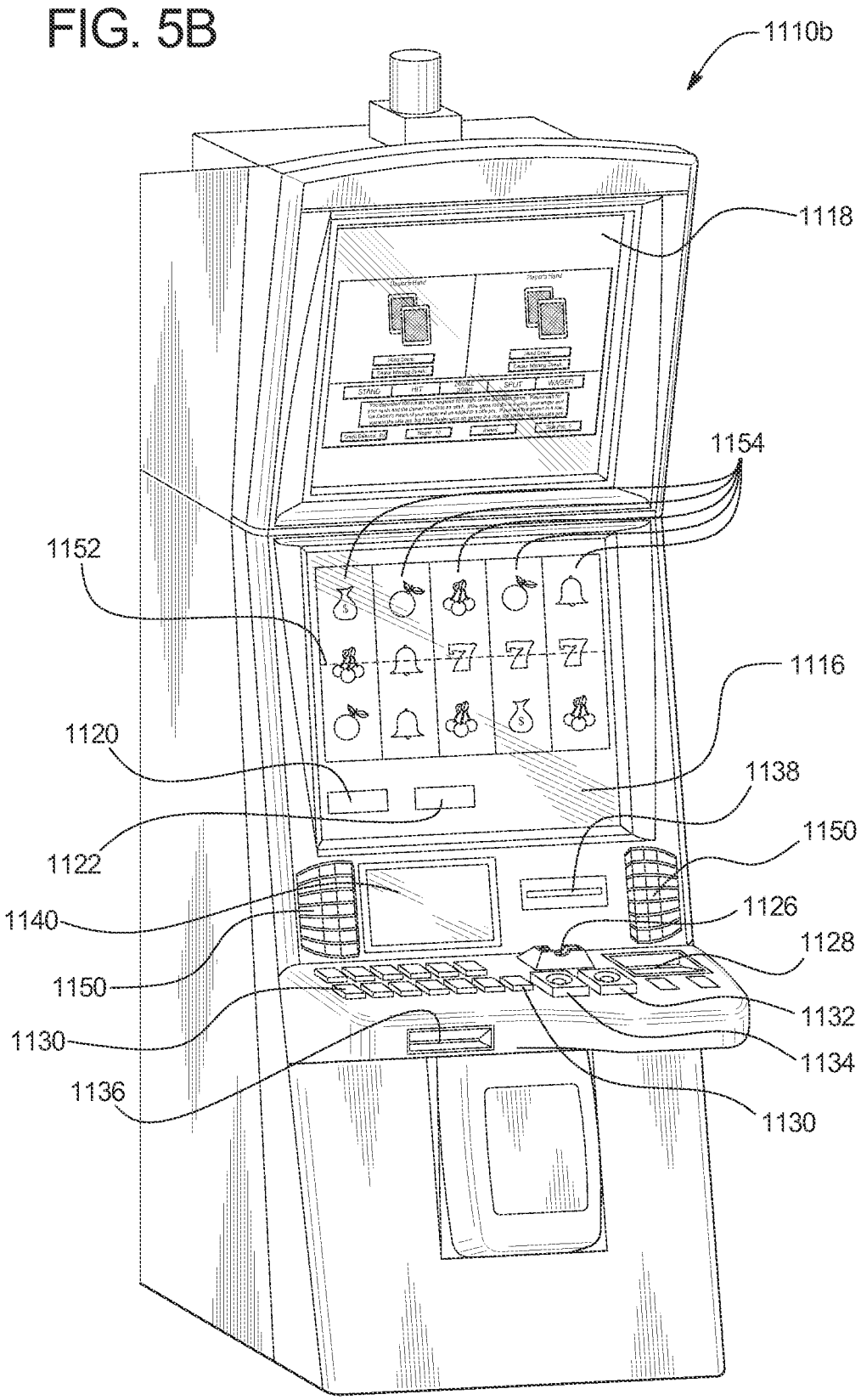

In various embodiments, the EGM includes one or more input devices. The input devices may include any suitable device that enables an input signal to be produced and received by the at least one processor of the EGM. The example EGM illustrated in FIG. 4B includes at least one input device 1030. One input device of the EGM is a payment device configured to communicate with the at least one processor of the EGM to fund the EGM. In certain embodiments, the payment device includes one or more of: (a) a bill acceptor into which paper money is inserted to fund the EGM; (b) a ticket acceptor into which a ticket or a voucher is inserted to fund the EGM; (c) a coin slot into which coins or tokens are inserted to fund the EGM; (d) a reader or a validator for credit cards, debit cards, or credit slips into which a credit card, debit card, or credit slip is inserted to fund the EGM; (e) a player identification card reader into which a player identification card is inserted to fund the EGM; or (f) any suitable combination thereof. FIGS. 5A and 5B illustrate example EGMs that each include the following payment devices: (a) a combined bill and ticket acceptor 1128, and (b) a coin slot 1126.

In one embodiment, the EGM includes a payment device configured to enable the EGM to be funded via an electronic funds transfer, such as a transfer of funds from a bank account. In another embodiment, the EGM includes a payment device configured to communicate with a mobile device of a player, such as a cell phone, a radio frequency identification tag, or any other suitable wired or wireless device, to retrieve relevant information associated with that player to fund the EGM. It should be appreciated that when the EGM is funded, the at least one processor determines the amount of funds entered and displays the corresponding amount on a credit display or any other suitable display as described below.

In various embodiments, one or more input devices of the EGM are one or more game play activation devices that are each used to initiate a play of a game on the EGM or a sequence of events associated with the EGM following appropriate funding of the EGM. The example EGMs illustrated in FIGS. 5A and 5B each include a game play activation device in the form of a game play initiation button 1132. It should be appreciated that, in other embodiments, the EGM begins game play automatically upon appropriate funding rather than upon utilization of the game play activation device.

In certain embodiments, one or more input devices of the EGM are one or more wagering or betting devices. One such wagering or betting device is as a maximum wagering or betting device that, when utilized, causes a maximum wager to be placed. Another such wagering or betting device is a repeat the bet device that, when utilized, causes the previously-placed wager to be placed. A further such wagering or betting device is a bet one device. A bet is placed upon utilization of the bet one device. The bet is increased by one credit each time the bet one device is utilized. Upon the utilization of the bet one device, a quantity of credits shown in a credit display (as described below) decreases by one, and a number of credits shown in a bet display (as described below) increases by one.

In other embodiments, one input device of the EGM is a cash out device. The cash out device is utilized to receive a cash payment or any other suitable form of payment corresponding to a quantity of remaining credits of a credit display (as described below). The example EGMs illustrated in FIGS. 5A and 5B each include a cash out device in the form of a cash out button 1134.

In certain embodiments, one input device of the EGM is a touch-screen coupled to a touch-screen controller or other touch-sensitive display overlay to enable interaction with any images displayed on a display device (as described below).

One such input device is a conventional touch-screen button panel. The touch-screen and the touch-screen controller are connected to a video controller. In these embodiments, signals are input to the EGM by touching the touch screen at the appropriate locations.

In various embodiments, one input device of the EGM is a sensor, such as a camera, in communication with the at least one processor of the EGM (and controlled by the at least one processor of the EGM in some embodiments) and configured to acquire an image or a video of a player using the EGM and/or an image or a video of an area surrounding the EGM.

In embodiments including a player tracking system, as further described below, one input device of the EGM is a card reader in communication with the at least one processor of the EGM. The example EGMs illustrated in FIGS. 5A and 5B each include a card reader 1138. The card reader is configured to read a player identification card inserted into the card reader.

In various embodiments, the EGM includes one or more output devices. The example EGM illustrated in FIG. 4B includes at least one output device 1060. One or more output devices of the EGM are one or more display devices configured to display any game(s) displayed by the EGM and any suitable information associated with such game(s). In certain embodiments, the display devices are connected to or mounted on a cabinet of the EGM (as described below). In various embodiments, the display devices serves as digital glass configured to advertise certain games or other aspects of the gaming establishment in which the EGM is located. In various embodiments, the EGM includes one or more of the following display devices: (a) a central display device; (b) a player tracking display configured to display various information regarding a player's player tracking status (as described below); (c) a secondary or upper display device in addition to the central display device and the player tracking display; (d) a credit display configured to display a current quantity of credits, amount of cash, account balance, or the equivalent; and (e) a bet display configured to display an amount wagered for one or more plays of one or more games. The example EGM illustrated in FIG. 4A includes a central display device 1116, a player tracking display 1140, a credit display 1120, and a bet display 1122. The example EGM illustrated in FIG. 4B includes a central display device 1116, an upper display device 1118, a player tracking display 1140, a player tracking display 1140, a credit display 1120, and a bet display 1122.

In various embodiments, the display devices include, without limitation: a monitor, a television display, a plasma display, a liquid crystal display (LCD), a display based on light emitting diodes (LEDs), a display based on a plurality of organic light-emitting diodes (OLEDs), a display based on polymer light-emitting diodes (PLEDs), a display based on a plurality of surface-conduction electron-emitters (SEDs), a display including a projected and/or reflected image, or any other suitable electronic device or display mechanism. In certain embodiments, as described above, the display device includes a touch-screen with an associated touch-screen controller. It should be appreciated that the display devices may be of any suitable sizes, shapes, and configurations.

The display devices of the EGM are configured to display one or more game and/or non-game images, symbols, and indicia. In certain embodiments, the display devices of the EGM are configured to display any suitable visual representation or exhibition of the movement of objects; dynamic lighting; video images; images of people, characters, places, things, and faces of cards; and the like. In certain embodiments, the display devices of the EGM are configured to display one or more video reels, one or more video wheels, and/or one or more video dice. In other embodiments, certain of the displayed images, symbols, and indicia are in mechanical form. That is, in these embodiments, the display device includes any electromechanical device, such as one or more rotatable wheels, one or more reels, and/or one or more dice, configured to display at least one or a plurality of game or other suitable images, symbols, or indicia.

In various embodiments, one output device of the EGM is a payout device. In these embodiments, when the cash out device is utilized as described above, the payout device causes a payout to be provided to the player. In one embodiment, the payout device is one or more of: (a) a ticket generator configured to generate and provide a ticket or credit slip representing a payout, wherein the ticket or credit slip may be redeemed via a cashier, a kiosk, or other suitable redemption system; (b) a note generator configured to provide paper currency; (c) a coin generator configured to provide coins or tokens in a coin payout tray; and (d) any suitable combination thereof. The example EGMs illustrated in FIGS. 5A and 5B each include ticket generator 1136. In one embodiment, the EGM includes a payout device configured to fund an electronically recordable identification card or smart card or a bank account via an electronic funds transfer.

In certain embodiments, one output device of the EGM is a sound generating device controlled by one or more sound cards. In one such embodiment, the sound generating device includes one or more speakers or other sound generating hardware and/or software for generating sounds, such as by playing music for any games or by playing music for other modes of the EGM, such as an attract mode. The example EGMs illustrated in FIGS. 5A and 5B each include a plurality of speakers 1150. In another such embodiment, the EGM provides dynamic sounds coupled with attractive multimedia images displayed on one or more of the display devices to provide an audio-visual representation or to otherwise display full-motion video with sound to attract players to the EGM. In certain embodiments, the EGM displays a sequence of audio and/or visual attraction messages during idle periods to attract potential players to the EGM. The videos may be customized to provide any appropriate information.

In various embodiments, the EGM includes a plurality of communication ports configured to enable the at least one processor of the EGM to communicate with and to operate with external peripherals, such as: accelerometers, arcade sticks, bar code readers, bill validators, biometric input devices, bonus devices, button panels, card readers, coin dispensers, coin hoppers, display screens or other displays or video sources, expansion buses, information panels, keypads, lights, mass storage devices, microphones, motion sensors, motors, printers, reels, SCSI ports, solenoids, speakers, thumbsticks, ticket readers, touch screens, trackballs, touchpads, wheels, and wireless communication devices. At least U.S. Patent Application Publication No. 2004/0254014 describes a variety of EGMs including one or more communication ports that enable the EGMs to communicate and operate with one or more external peripherals.

As generally described above, in certain embodiments, such as the example EGMs illustrated in FIGS. 5A and 5B, the EGM has a support structure, housing, or cabinet that provides support for a plurality of the input device and the output devices of the EGM. Further, the EGM is configured such that a player may operate it while standing or sitting. In various embodiments, the EGM is positioned on a base or stand, or is configured as a pub-style tabletop game (not shown) that a player may operate typically while sitting. As illustrated by the different example EGMs shown in FIGS. 5A and 5B, EGMs may have varying cabinet and display configurations.

It should be appreciated that, in certain embodiments, the EGM is a device that has obtained approval from a regulatory gaming commission, and in other embodiments, the EGM is a device that has not obtained approval from a regulatory gaming commission.

As explained above, for brevity and clarity, both the EGMs and the personal gaming devices of the present disclosure are collectively referred to herein as "EGMs." Accordingly, it should be appreciated that certain of the example EGMs described above include certain elements that may not be included in all EGMs. For example, the payment device of a personal gaming device such as a mobile telephone may not include a coin acceptor, while in certain instances the payment device of an EGM located in a gaming establishment may include a coin acceptor.

Operation of Primary or Base Games and/or Secondary or Bonus Games

In various embodiments, an EGM may be implemented in one of a variety of different configurations. In various embodiments, the EGM may be implemented as one of: (a) a dedicated EGM wherein computerized game programs executable by the EGM for controlling any primary or base games (referred to herein as "primary games") and/or any secondary or bonus games or other functions (referred to herein as "secondary games") displayed by the EGM are provided with the EGM prior to delivery to a gaming establishment or prior to being provided to a player; and (b) a changeable EGM wherein computerized game programs executable by the EGM for controlling any primary games and/or secondary games displayed by the EGM are downloadable to the EGM through a data network or remote communication link after the EGM is physically located in a gaming establishment or after the EGM is provided to a player.

As generally explained above, in various embodiments in which the gaming system includes a central server, central controller, or remote host and a changeable EGM, the at least one memory device of the central server, central controller, or remote host stores different game programs and instructions executable by the at least one processor of the changeable EGM to control one or more primary games and/or secondary games displayed by the changeable EGM. More specifically, each such executable game program represents a different game or a different type of game that the at least one changeable EGM is configured to operate. In one example, certain of the game programs are executable by the changeable EGM to operate games having the same or substantially the same game play but different paytables. In different embodiments, each executable game program is associated with a primary game, a secondary game, or both. In certain embodiments, an executable game program is executable by the at least one processor of the at least one changeable EGM as a secondary game to be played simultaneously with a play of a primary game (which may be downloaded to or otherwise stored on the at least one changeable EGM), or vice versa.

In operation of such embodiments, the central server, central controller, or remote host is configured to communicate one or more of the stored executable game programs to the at least one processor of the changeable EGM. In different embodiments, a stored executable game program is communicated or delivered to the at least one processor of the changeable EGM by: (a) embedding the executable game program in a device or a component (such as a microchip to be inserted into the changeable EGM); (b) writing the executable game program onto a disc or other media; or (c) uploading or streaming the executable game program over a data network (such as a dedicated data network). After the executable game program is communicated from the central server, central controller, or remote host to the changeable EGM, the at least one processor of the changeable EGM executes the executable game program to enable the primary game and/or the secondary game associated with that executable game program to be played using the display device(s) and/or the input device(s) of the changeable EGM. That is, when an executable game program is communicated to the at least one processor of the changeable EGM, the at least one processor of the changeable EGM changes the game or the type of game that may be played using the changeable EGM.

In certain embodiments, the gaming system randomly determines any game outcome(s) (such as a win outcome) and/or award(s) (such as a quantity of credits to award for the win outcome) for a play of a primary game and/or a play of a secondary game based on probability data. In certain such embodiments, this random determination is provided through utilization of an RNG, such as a true RNG or a pseudo RNG, or any other suitable randomization process. In one such embodiment, each game outcome or award is associated with a probability, and the gaming system generates the game outcome(s) and/or the award(s) to be provided based on the associated probabilities. In these embodiments, since the gaming system generates game outcomes and/or awards randomly or based on one or more probability calculations, there is no certainty that the gaming system will ever provide any specific game outcome and/or award.

In certain embodiments, the gaming system maintains one or more predetermined pools or sets of predetermined game outcomes and/or awards. In certain such embodiments, upon generation or receipt of a game outcome and/or award request, the gaming system independently selects one of the predetermined game outcomes and/or awards from the one or more pools or sets. The gaming system flags or marks the selected game outcome and/or award as used. Once a game outcome or an award is flagged as used, it is prevented from further selection from its respective pool or set; that is, the gaming system does not select that game outcome or award upon another game outcome and/or award request. The gaming system provides the selected game outcome and/or award. At least U.S. Pat. Nos. 7,470,183; 7,563,163; and 7,833,092 and U.S. Patent Application Publication Nos. 2005/0148382, 2006/0094509, and 2009/0181743 describe various examples of this type of award determination.

In certain embodiments, the gaming system determines a predetermined game outcome and/or award based on the results of a bingo, keno, or lottery game. In certain such embodiments, the gaming system utilizes one or more bingo, keno, or lottery games to determine the predetermined game outcome and/or award provided for a primary game and/or a secondary game. The gaming system is provided or associated with a bingo card. Each bingo card consists of a matrix or array of elements, wherein each element is designated with separate indicia. After a bingo card is provided, the gaming system randomly selects or draws a plurality of the elements. As each element is selected, a determination is made as to whether the selected element is present on the bingo card. If the selected element is present on the bingo card, that selected element on the provided bingo card is marked or flagged. This process of selecting elements and marking any selected elements on the provided bingo cards continues until one or more predetermined patterns are marked on one or more of the provided bingo cards. After one or more predetermined patterns are marked on one or more of the provided bingo cards, game outcome and/or award is determined based, at least in part, on the selected elements on the provided bingo cards. At least U.S. Pat. Nos. 7,753,774; 7731,581; 7,955,170; and 8,070,579 and U.S. Patent Application Publication No. 2011/0028201 describe various examples of this type of award determination.

In certain embodiments in which the gaming system includes a central server, central controller, or remote host and an EGM, the EGM is configured to communicate with the central server, central controller, or remote host for monitoring purposes only. In such embodiments, the EGM determines the game outcome(s) and/or award(s) to be provided in any of the manners described above, and the central server, central controller, or remote host monitors the activities and events occurring on the EGM. In one such embodiment, the gaming system includes a real-time or online accounting and gaming information system configured to communicate with the central server, central controller, or remote host. In this embodiment, the accounting and gaming information system includes: (a) a player database for storing player profiles, (b) a player tracking module for tracking players (as described below), and (c) a credit system for providing automated transactions. At least U.S. Pat. No. 6,913,534 and U.S. Patent Application Publication No. 2006/0281541 describe various examples of such accounting systems.

As noted above, in various embodiments, the gaming system includes one or more executable game programs executable by at least one processor of the gaming system to provide one or more primary games and one or more secondary games. The primary game(s) and the secondary game(s) may comprise any suitable games and/or wagering games, such as, but not limited to: electro-mechanical or video slot or spinning reel type games; video card games such as video draw poker, multi-hand video draw poker, other video poker games, video blackjack games, and video baccarat games; video keno games; video bingo games; and video selection games.

In certain embodiments in which the primary game is a slot or spinning reel type game, the gaming system includes one or more reds in either an electromechanical form with mechanical rotating reds or in a video form with simulated reds and movement thereof. Each red displays a plurality of indicia or symbols, such as bells, hearts, fruits, numbers, letters, bars, or other images that typically correspond to a theme associated with the gaming system. In certain such embodiments, the gaming system includes one or more paylines associated with the reds. The example EGM shown in FIG. 5B each includes a payline 1152 and a plurality of reds 1154. In certain embodiments, one or more of the reds are independent reds or unisymbol reds. In such embodiments, each independent red generates and displays one symbol.

In various embodiments, one or more of the paylines is horizontal, vertical, circular, diagonal, angled, or any suitable combination thereof. In other embodiments, each of one or more of the paylines is associated with a plurality of adjacent symbol display areas on a requisite number of adjacent reels. In one such embodiment, one or more paylines are formed between at least two symbol display areas that are adjacent to each other by either sharing a common side or sharing a common corner (i.e., such paylines are connected paylines). The gaming system enables a wager to be placed on one or more of such paylines to activate such paylines. In other embodiments in which one or more paylines are formed between at least two adjacent symbol display areas, the gaming system enables a wager to be placed on a plurality of symbol display areas, which activates those symbol display areas.

In various embodiments, the gaming system provides one or more awards after a spin of the reels when specified types and/or configurations of the indicia or symbols on the reels occur on an active payline or otherwise occur in a winning pattern, occur on the requisite number of adjacent reels, and/or occur in a scatter pay arrangement.

In certain embodiments, the gaming system employs a ways to win award determination. In these embodiments, any outcome to be provided is determined based on a number of associated symbols that are generated in active symbol display areas on the requisite number of adjacent reels (i.e., not on paylines passing through any displayed winning symbol combinations). If a winning symbol combination is generated on the reels, one award for that occurrence of the generated winning symbol combination is provided. At least U.S. Pat. No. 8,012,011 and U.S. Patent Application Publication Nos. 2008/0108408 and 2008/0132320 describe various examples of ways to win award determinations.

In various embodiments, the gaming system includes a progressive award. Typically, a progressive award includes an initial amount and an additional amount funded through a portion of each wager placed to initiate a play of a primary game. When one or more triggering events occurs, the gaming system provides at least a portion of the progressive award. After the gaining system provides the progressive award, an amount of the progressive award is reset to the initial amount and a portion of each subsequent wager is allocated to the next progressive award. At least U.S. Pat. Nos. 5,766,079; 7,585,223; 7,651,392; 7,666,093; 7,780,523; and 7,905,778 and U.S. Patent Application Publication Nos. 2008/0020846, 2009/0123364, 2009/0123363, and 2010/0227677 describe various examples of different progressive gaming systems.

As generally noted above, in addition to providing winning credits or other awards for one or more plays of the primary game(s), in various embodiments the gaming system provides credits or other awards for one or more plays of one or more secondary games. The secondary game typically enables a prize or payout in to be obtained addition to any prize or payout obtained through play of the primary game(s). The secondary game(s) typically produces a higher level of player excitement than the primary game(s) because the secondary game(s) provides a greater expectation of winning than the primary game(s) and is accompanied with more attractive or unusual features than the primary game(s). It should be appreciated that the secondary game(s) may be any type of suitable game, either similar to or completely different from the primary game.

In various embodiments, the gaming system automatically provides or initiates the secondary game upon the occurrence of a triggering event or the satisfaction of a qualifying condition. In other embodiments, the gaming system initiates the secondary game upon the occurrence of the triggering event or the satisfaction of the qualifying condition and upon receipt of an initiation input. In certain embodiments, the triggering event or qualifying condition is a selected outcome in the primary game(s) or a particular arrangement of one or more indicia on a display device for a play of the primary game(s), such as a "BONUS" symbol appearing on three adjacent reels along a payline following a spin of the reels for a play of the primary game. In other embodiments, the triggering event or qualifying condition occurs based on a certain amount of game play (such as number of games, number of credits, amount of time) being exceeded, or based on a specified number of points being earned during game play. It should be appreciated that any suitable triggering event or qualifying condition or any suitable combination of a plurality of different triggering events or qualifying conditions may be employed.

In other embodiments, at least one processor of the gaming system randomly determines when to provide one or more plays of one or more secondary games. In one such embodiment, no apparent reason is provided for the providing of the secondary game. In this embodiment, qualifying for a secondary game is not triggered by the occurrence of an event in any primary game or based specifically on any of the plays of any primary game. That is, qualification is provided without any explanation or, alternatively, with a simple explanation. In another such embodiment, the gaming system determines qualification for a secondary game at least partially based on a game triggered or symbol triggered event, such as at least partially based on play of a primary game.

In various embodiments, after qualification for a secondary game has been determined, the secondary game participation may be enhanced through continued play on the primary game. Thus, in certain embodiments, for each secondary game qualifying event, such as a secondary game symbol, that is obtained, a given number of secondary game wagering points or credits is accumulated in a "secondary game meter" configured to accrue the secondary game wagering credits or entries toward eventual participation in the secondary game. In one such embodiment, the occurrence of multiple such secondary game qualifying events in the primary game results in an arithmetic or exponential increase in the number of secondary game wagering credits awarded. In another such embodiment, any extra secondary game wagering credits may be redeemed during the secondary game to extend play of the secondary game.

In certain embodiments, no separate entry fee or buy-in for the secondary game is required. That is, entry into the secondary game cannot be purchased; rather, in these embodiments entry must be won or earned through play of the primary game, thereby encouraging play of the primary game. In other embodiments, qualification for the secondary game is accomplished through a simple "buy-in." For example, qualification through other specified activities is unsuccessful, payment of a fee or placement of an additional wager "buys-in" to the secondary game. In certain embodiments, a separate side wager must be placed on the secondary game or a wager of a designated amount must be placed on the primary game to enable qualification for the secondary game. In these embodiments, the secondary game triggering event must occur and the side wager (or designated primary game wager amount) must have been placed for the secondary game to trigger.

In various embodiments in which the gaming system includes a plurality of EGMs, the EGMs are configured to communicate with one another to provide a group gaming environment. In certain such embodiments, the EGMs enable players of those EGMs to work in conjunction with one another, such as by enabling the players to play together as a team or group, to win one or more awards. In other such embodiments, the EGMs enable players of those EGMs to compete against one another for one or more awards. In one such embodiment, the EGMs enable the players of those EGMs to participate in one or more gaming tournaments for one or more awards. At least U.S. Patent Application Publication Nos. 2007/0123341, 2008/0070680, 2008/0176650, and 2009/0124363 describe various examples of different group gaming systems.

In various embodiments, the gaming system includes one or more player tracking systems. Such player tracking systems enable operators of the gaming system (such as casinos or other gaming establishments) to recognize the value of customer loyalty by identifying frequent customers and rewarding them for their patronage. Such a player tracking system is configured to track a player's gaming activity. In one such embodiment, the player tracking system does so through the use of player tracking cards. In this embodiment, a player is issued a player identification card that has an encoded player identification number that uniquely identifies the player. When the player's playing tracking card is inserted into a card reader of the gaming system to begin a gaming session, the card reader reads the player identification number off the player tracking card to identify the player. The gaming system timely tracks any suitable information or data relating to the identified player's gaming session. The gaming system also timely tracks when the player tracking card is removed to conclude play for that gaming session. In another embodiment, rather than requiring insertion of a player tracking card into the card reader, the gaming system utilizes one or more portable devices, such as a cell phone, a radio frequency identification tag, or any other suitable wireless device, to track when a gaming session begins and ends. In another embodiment, the gaming system utilizes any suitable biometric technology or ticket technology to track when a gaming session begins and ends.

In such embodiments, during one or more gaming sessions, the gaming system tracks any suitable information or data, such as any amounts wagered, average wager amounts, and/or the time at which these wagers are placed. In different embodiments, for one or more players, the player tracking system includes the player's account number, the player's card number, the player's first name, the player's surname, the player's preferred name, the player's player tracking ranking, any promotion status associated with the player's player tracking card, the player's address, the player's birthday, the player's anniversary, the player's recent gaming sessions, or any other suitable data. In various embodiments, such tracked information and/or any suitable feature associated with the player tracking system is displayed on a player tracking display. In various embodiments, such tracked information and/or any suitable feature associated with the player tracking system is displayed via one or more service windows that are displayed on the central display device and/or the upper display device. At least U.S. Pat. Nos. 6,722,985; 6,908,387; 7,311,605; 7,611,411; 7,617,151; and 8,057,298 describe various examples of player tracking systems.

It should be understood that various changes and modifications to the present embodiments described herein will be apparent to those skilled in the art. Such changes and modifications can be made without departing from the spirit and scope of the present subject matter and without diminishing its intended advantages. It is therefore intended that such changes and modifications be covered by the appended claims.

The invention is claimed as follows:

1. A gaming system comprising:

a housing;

at least one processor;

at least one display device supported by the housing;

a plurality of input devices supported by the housing, the plurality of input devices including an acceptor, a validator, a wager button, and a cashout button; and at least one memory device storing a plurality of instructions which, when executed by the at least one processor, cause the at least one processor to operate with the at least one display device and the plurality of input devices to:

(a) receive, via the acceptor, a first physical item associated with a first monetary value;

(b) identify, via the validator, the received first physical item;

(c) establish a credit balance based at least in part on the first monetary value associated with the received first physical item;

(d) for a play of a game associated with a plurality of symbols:

(i) receive an actuation of the wager button, said actuation of the wager button associated with a wager amount;

(ii) deduct the wager amount from the credit balance;

(iii) randomly determine a plurality of player symbols from the plurality of symbols;

(iv) display the player symbols;

(v) randomly determine a plurality of opponent symbols from the plurality of symbols;

(vi) display at least one of the opponent symbols;

(vii) determine an outcome of said play of the game based on a comparison of the player symbols and the opponent symbols;

(viii) if the determined outcome is a designated outcome, fund a supplemental pool with at least part of the received wager amount;

(ix) if a supplemental pool reset condition other than the player winning the supplemental pool is met, reset a value of the supplemental pool to an initial value; and (x) if a supplemental pool payout condition is met, modify the credit balance based on the supplemental pool; and (e) if an actuation of the cashout button is received, cause an initiation of a payout associated with the credit balance.

2. The gaming system of claim 1, wherein the first designated outcome is a push outcome.

3. The gaming system of claim 2, wherein the determined outcome is the push outcome when:

(a) a sum of values of the player symbols is less than or equal to twenty-one;

(b) a sum of values of the opponent symbols is less than or equal to twenty-one; and (c) the sum of the values of the player symbols is equal to the sum of the values of the opponent symbols.

4. The gaming system of claim 2, wherein the determined outcome is a push outcome when:

(a) a rank of a first player set of symbols formed from the player symbols is higher than a rank of a first opponent set of symbols formed from the opponent symbols; and (b) a rank of a second opponent set of symbols formed from the opponent symbols is higher than a rank of a second player set of symbols formed from the player symbols.

5. The gaming system of claim 1, wherein the supplemental pool reset condition is met when the opponent has won a first designated quantity of consecutive plays of the game.

6. The gaming system of claim 5, wherein the supplemental pool payout condition is met when the player has won a second designated quantity of consecutive plays of the game.

7. The gaming system of claim 6, wherein the first designated quantity is greater than the second designated quantity.

8. The gaming system of claim 1, wherein the supplemental pool reset condition is met when a rank of the opponent symbols is a first designated rank.

9. The gaming system of claim 8, wherein the supplemental pool payout condition is met when a rank of the player symbols is a second designated rank.

10. The gaming system of claim 9, wherein the first designated rank is the same as the second designated rank.

11. The gaming system of claim 9, wherein the first designated rank and the second designated rank are different.

12. The gaming system of claim 1, wherein the plurality of instructions, when executed by the at least one processor, cause the at least one processor to, if the determined outcome is a designated outcome, fund the supplemental pool with the entire received wager amount.

13. The gaming system of claim 12, wherein the plurality of instructions, when executed by the at least one processor, cause the at least one processor to, if the determined outcome is the designated outcome, fund the supplemental pool with an additional amount of credits equal to an amount of the received wager amount used to fund the supplemental pool.

14. The gaming system of claim 1, wherein the plurality of instructions, when executed by the at least one processor, cause the at least one processor to, if the supplemental pool payout condition is met, reset the value of the supplemental pool to the initial value after modifying the credit balance based on the supplemental pool.

15. A method of operating a gaming system, said method comprising:

(i) receiving, via an acceptor, a first physical item associated with a first monetary value;

(ii) identifying, via a validator, the received first physical item;

(iii) causing at least one processor to execute a plurality of instructions stored in at least one memory device to establish a credit balance based at least in part on the first monetary value associated with the received first physical item;

(iv) for a play of a game associated with a plurality of symbols:

(a) receiving an actuation of a wager button, said actuation of the wager button associated with a wager amount;

(b) causing the at least one processor to execute the plurality of instructions to deduct the wager amount from the credit balance;

(c) causing the at least one processor to execute the plurality of instructions to determine a plurality of player symbols from the plurality of symbols;

(d) causing the at least one processor to execute the plurality of instructions to operate with at least one display device to display the player symbols;

(e) causing the at least one processor to execute the plurality of instructions to randomly determine a plurality of opponent symbols from the plurality of symbols;

(f) causing the at least one processor to execute the plurality of instructions to operate with the at least one display device to display at least one of the opponent symbols face up;

(g) causing the at least one processor to execute the plurality of instructions to determine an outcome of said play of the game based on a comparison of the player symbols and the opponent symbols;

(h) if the determined outcome is a designated outcome, causing the at least one processor to execute the plurality of instructions to fund a supplemental pool with at least part of the received wager amount;

(i) if a supplemental pool reset condition other than the player winning the supplemental pool is met, causing the at least one processor to execute the plurality of instructions to reset a value of the supplemental pool to an initial value; and (j) if a supplemental pool payout condition is met, causing the at least one processor to execute the plurality of instructions to modify the credit balance based on the supplemental pool; and (v) if an actuation of a cashout button is received, causing the at least one processor to execute the plurality of instructions to initiate a payout associated with the credit balance.

16. The method of claim 15, wherein the first designated outcome is a push outcome.

17. The method of claim 16, wherein the determined outcome is the push outcome when:

(a) a sum of values of the player symbols is less than or equal to twenty-one;

(b) a sum of values of the opponent symbols is less than or equal to twenty-one; and (c) the sum of the values of the player symbols is equal to the sum of the values of the opponent symbols.

18. The method of claim 16, wherein the determined outcome is a push outcome when:

(a) a rank of a first player set of symbols formed from the player symbols is higher than a rank of a first opponent set of symbols formed from the opponent symbols, and (b) a rank of a second opponent set of symbols formed from the opponent symbols is higher than a rank of a second player set of symbols formed from the player symbols.

19. The method of claim 15, wherein the supplemental pool reset condition is met when the opponent has won a first designated quantity of consecutive plays of the game.

20. The method of claim 19, wherein the supplemental pool payout condition is met when the player has won a second designated quantity of consecutive plays of the game.

21. The method of claim 20, wherein the first designated quantity is greater than the second designated quantity.

22. The method of claim 15, wherein the supplemental pool reset condition is met when a rank of the opponent symbols is a first designated rank.

23. The method of claim 22, wherein the supplemental pool payout condition is met when a rank of the player symbols is a second designated rank.

24. The method of claim 23, wherein the first designated rank is the same as the second designated rank.

25. The method of claim 23, wherein the first designated rank and the second designated rank are different.

26. The method of claim 15, which includes causing the at least one processor to execute the plurality of instructions to, if the determined outcome is a designated outcome, fund the supplemental pool with the entire received wager amount.

27. The method of claim 26, which includes causing the at least one processor to execute the plurality of instructions to, if the determined outcome is the designated outcome, fund the supplemental pool with an additional amount of credits equal to an amount of the received wager amount used to fund the supplemental pool.

28. The method of claim 15, which includes causing the at least one processor to execute the plurality of instructions to, if the supplemental pool payout condition is met, reset the value of the supplemental pool to the initial value after modifying the credit balance based on the supplemental pool.

29. The method of claim 15, which is provided through a data network.

30. The method of claim 29, wherein the data network is an internet.

31. A non-transitory computer readable medium storing a plurality of instructions which, when executed by at least one processor, cause the at least one processor to:

following receipt of a first physical item associated with a first monetary value by an acceptor and identification of the first physical item by a validator, establish a credit balance based at least in part on the first monetary value associated with the received first physical item;

for a play of a game associated with a plurality of symbols:

(a) following receipt of an actuation of a wager button, said actuation of the wager button associated with a wager amount, deduct the wager amount from the credit balance;

(b) determine a plurality of player symbols from the plurality of symbols;

(c) cause at least one display device to display the player symbols;

(d) randomly determine a plurality of opponent symbols from the plurality of symbols;

(e) cause the at least one display device to display at least one of the opponent symbols;

(f) determine an outcome of said play of the game based on a comparison of the player symbols and the opponent symbols;

(g) if the determined outcome is a designated outcome, fund a supplemental pool with at least part of the received wager amount;

(h) if a supplemental pool reset condition other than the player winning the supplemental pool is met, reset a value of the supplemental pool to an initial value; and (i) if a supplemental pool payout condition is met, modify the credit balance based on the supplemental pool; and if an actuation of a cashout button is received, cause an initiation of a payout associated with the credit balance.

32. The non-transitory computer readable medium of claim 31, wherein the first designated outcome is a push outcome.

33. The non-transitory computer readable medium of claim 32, wherein the determined outcome is the push outcome when:

(a) a sum of values of the player symbols is less than or equal to twenty-one;

(b) a sum of values of the opponent symbols is less than or equal to twenty-one; and (c) the sum of the values of the player symbols is equal to the sum of the values of the opponent symbols.

34. The non-transitory computer readable medium of claim 32, wherein the determined outcome is a push outcome when:

(a) a rank of a first player set of symbols formed from the player symbols is higher than a rank of a first opponent set of symbols formed from the opponent symbols; and (b) a rank of a second opponent set of symbols formed from the opponent symbols is higher than a rank of a second player set of symbols formed from the player symbols.

35. The non-transitory computer readable medium of claim 31, wherein the supplemental pool reset condition is met when the opponent has won a first designated quantity of consecutive plays of the game.

36. The non-transitory computer readable medium of claim 35, wherein the supplemental pool payout condition is met when the player has won a second designated quantity of consecutive plays of the game.

37. The non-transitory computer readable medium of claim 36, wherein the first designated quantity is greater than the second designated quantity.

38. The non-transitory computer readable medium of claim 31, wherein the supplemental pool reset condition is met when a rank of the opponent symbols is a first designated rank.

39. The non-transitory computer readable medium of claim 38, wherein the supplemental pool payout condition is met when a rank of the player symbols is a second designated rank.

40. The non-transitory computer readable medium of claim 39, wherein the first designated rank is the same as the second designated rank.

41. The non-transitory computer readable medium of claim 39, wherein the first designated rank and the second designated rank are different.

42. The non-transitory computer readable medium of claim 31, wherein the plurality of instructions, when executed by the at least one processor, cause the at least one processor to, if the determined outcome is a designated outcome, fund the supplemental pool with the entire received wager amount.

43. The non-transitory computer readable medium of claim 42, wherein the plurality of instructions, when executed by the at least one processor, cause the at least one processor to, if the determined outcome is the designated outcome, fund the supplemental pool with an additional amount of credits equal to an amount of the received wager amount used to fund the supplemental pool.

44. The non-transitory computer readable medium of claim 31, wherein the plurality of instructions, when executed by the at least one processor, cause the at least one processor to, if the supplemental pool payout condition is met, reset the value of the supplemental pool to the initial value after modifying the credit balance based on the supplemental pools.

* * * * *